US006086058A

United States Patent [19]

Brauch et al.

[11] Patent Number: 6,086,058

[45] Date of Patent: Jul. 11, 2000

[54] METHOD FOR COMPOUND MOVEMENT OF AN AERATION UNIT

[75] Inventors: Joseph Karl Brauch; Charles Lonnie Meurer, both of Golden; Douglas Lee Meurer, Denver, all of Colo.

[73] Assignee: Meurer Industries, Inc., Golden, Colo.

[21] Appl. No.: 09/385,926

[22] Filed: Aug. 30, 1999

Related U.S. Application Data

[60] Division of application No. 09/026,952, Feb. 20, 1998, Pat. No. 5,945,040, which is a continuation-in-part of application No. 08/816,870, Mar. 13, 1997, Pat. No. 5,804,104.

[51] Int. Cl.[7] ..... B01F 3/04

[52] U.S. Cl. ..... 261/122.1; 261/124; 261/DIG. 70; 210/220; 210/237

[58] Field of Search ..... 261/121.1, 122.1, 261/124, DIG. 47, DIG. 70; 210/220, 237, 238; 187/213, 256; 414/808, 814

[56] References Cited

U.S. PATENT DOCUMENTS

| | | | |
|---|---|---|---|
| 2,144,385 | 1/1939 | Nordell | 210/220 |
| 2,328,655 | 9/1943 | Lannert | 261/122.1 |
| 2,650,810 | 9/1953 | Nordell | 261/121.1 |
| 3,864,441 | 2/1975 | Suzuki | 261/DIG. 47 |
| 4,401,335 | 8/1983 | Godbersen | 187/213 |
| 4,431,597 | 2/1984 | Cramer et al. | 261/DIG. 47 |
| 4,477,939 | 10/1984 | White et al. | 210/232 |
| 5,018,925 | 5/1991 | Ganser | 187/213 |
| 5,427,471 | 6/1995 | Godbersen | 187/213 |
| 5,804,104 | 9/1998 | Brauch et al. | 261/122.1 |
| 5,945,040 | 8/1999 | Brauch et al. | 261/122.1 |

FOREIGN PATENT DOCUMENTS 1254225 1/1961 France .

*Primary Examiner*—C. Scott Bushey
*Attorney, Agent, or Firm*—C. E. Martine, Jr.

[57] ABSTRACT

Improvements are made to a system in which force is applied to aeration units from only one side of a basin. Part of such force is vector transferred from one end of a beam of the aeration unit to the other end of the beam to move both ends of the beam. The beam supports pipes of the aeration unit. A force transfer module includes one force transfer strand held in a force transfer path between fixed opposite ends of the strand. The force transfer path extends in part along the beam, which is placed in compression. Motion of the one end of the beam resulting from the force is transferred by the single force transfer strand to the opposite end of the beam so that both ends of the beam move relative to the basin under the action of the force. The improvements include guides on the beam for allowing the pipes of the aeration unit to move off the beam to a side of the basin for servicing, a levelling device for positioning ends of the pipes level with each other to enable the pipes to introduce uniform amounts of gas into the basin, and a plurality of vector force transfer modules provided across the basin to apply forces to the beam at many locations.

5 Claims, 34 Drawing Sheets

FIG. 11

STEP 100: PROVIDE THE FLEXIBLE FORCE TRANSFER STRAND HAVING FIRST AND SECOND OPPOSITE ENDS AND A TOTAL STRAND LENGTH THAT IS SUBSTANTIALLY CONSTANT UNDER TENSION.

STEP 200: PLACE THE FLEXIBLE FORCE TRANSFER STRAND IN THE FORCE TRANSFER PATH WITH THE OPPOSITE ENDS FIXED AGAINST MOVEMENT.

STEP 300: MOVE THE COMPRESSION MEMBER BY APPLYING THE PRIMARY FORCE TO THE PROXIMAL END OF THE COMPRESSION MEMBER.

STEP 400: TRANSFER SOME OF THE PRIMARY FORCE TO THE DISTAL END (AS THE TRANSFERRED FORCE $F_T$), PLACE THE COMPRESSION MEMBER IN COMPRESSION, AND USE THE FORCE $F_{L\text{-}U}$ TO MOVE THE DISTAL END.

METHOD FOR COMPOUND MOVEMENT OF AN AERATION UNIT

RELATED APPLICATION

This Application is a Divisional Application of application Ser. No. 09/026,952, filed Feb. 20, 1998, issued as U.S. Pat. No. 5,945,040 on Aug. 31, 1999, which Patent is a Continuation-in-Part of application Ser. No. 08/816,870 filed Mar. 13, 1997 and issued as U.S. Pat. No. 5,804,104.

BACKGROUND OF THE INVENTION

1. Field of the Invention

This invention relates to providing compound movement of an aeration unit, and more particularly, to first applying a primary force to an aeration unit of a water treatment apparatus to remove the aeration unit from the water treatment apparatus, and to second applying a secondary force to the aeration unit to move the entire aeration unit over a service area adjacent to the water treatment apparatus to facilitate servicing the aeration unit.

2. Discussion of Prior Aeration Unit Movers

Basins are used to purify liquids in facilities such as water and waste water treatment plants by removing impurities, thereby making the water suitable for use, reuse, or for further treatment. Aeration units are used in basins of the plants to provide gas for biological treatment, or for mixing the liquid. The aeration units are usually permanently installed in the basin. In many permanent installations, the pipes of the units are secured to the bottom of the basin to resist the inherent buoyancy of the pipes, which are filled with the gas. Thus, removal of the pipes for maintenance is difficult, if not impossible, without interrupting the aeration process.

Some have suggested the use of pipes with rotary joints to couple sections of the pipes together. In prior aeration units with removable pipes, the individual pipes and valves are generally difficult to handle. Where supports other than the bottom of the basin have been provided for the aeration units, hoists or cranes have been used to lift the supports. Such hoists or cranes often interfere with the aeration operations, and do not provide an easy way of repositioning the supports on the bottom so as to assure that the pipes of the aeration units are level during aeration operations. Further, the many different types of aeration units do not lend themselves to a universal, or all-purpose, way of retrieving the units from a basin for maintenance, and of replacing the units in the basin after maintenance with assurance that the pipes of the aeration unit will be level. Thus, there is a need for a way of retrieving from such basins all types of aeration units, including units that have already been installed, with a minimum of interference with ongoing aeration operations. Also, since plant operators are generally reluctant to increase investment just to maintain the existing aeration units, any new equipment for removal and replacement of existing aeration units must be as simple and cost-effective as possible.

The term "retrieval", and the term "retrieving", as used herein mean the removal of any type of aeration unit from such basin (e.g., for maintenance) and the movement of any such type of aeration unit into such basin, (e.g., following maintenance).

Other factors relating to maintenance of such aeration units include that, for efficient operation, controls for equipment that performs such retrieval, and preferably maintenance operations, should be centralized. Centralization, for example, means that the controls and the maintenance operations should be on the same one side of the basin, for ease of access by an operator or maintenance person.

An example of an attempt to retrieve one aerator pipe at a time from a basin is shown in Nordell U.S. Pat. No. 2,650,810. There, dual lengths of a single, main endless band extend parallel to each other along a coping at an edge of a basin. The coping extends above the pipe. At each of many spaced locations along the main band, separate cables are attached to the main band and extend around fixed pulleys secured to the coping. Each separate cable then extends down into the basin and is attached directly to a different part of the aeration pipe. As the main band is moved along the coping, one end of each separate cable moves with the main band, and the attached part of the cable moves up or down in the basin. With the attached part of each such cable attached to the aeration pipe, the cables move the aeration pipe up in the basin. This type of pipe moving system is provided for each aeration pipe. Further, it requires the two lengths of the main band to extend along the coping of the basin so that the separate cables may be attached to the main band and extend down into the basin so as to directly apply force to the pipe at locations spaced across the basin. Also, if an aeration pipe is centered in the basin, i.e. toward the center from the coping, a separate truss has to be mounted across the top of the basin to support the fixed pulleys which are normally secured to the coping when the pipe is directly below the coping. The extension of the main band across the coping of the basin, and such separate truss, may interfere with operations other than aeration.

In another method of moving a device for aerating liquid in a basin, shown in U.S. Pat. No. 2,144,385, a fixed rail is mounted in the basin for guiding sliders that carry pipe holders. The holders surround the pipe to avoid stressing the pipe. A cable pulls the sliders on the rail to move the pipe into and out of the basin. However, opposite ends of the cable exit the basin at opposite sides of the basin, such that there is no central point at which the cable is moved. Further, the pipe can only be removed in this manner if it is flexible.

Still another device for aerating liquid also requires use of a flexible, porous pipe for supplying the gas to the liquid. As described in U.S. Pat. No. 5,290,487, holders are fixed to the pipe, and the holders have sliders that ride on a rail attached to the bottom of the basin. The U.S. Pat. No. 5,290,487 describes problems encountered with such porous flexible pipe, holders, sliders and rails as including those caused by pulling on the pipe to cause the pipe to be guided into the basin by the sliders as they ride on the rail fixed to the floor of the basin. The force required to pull the pipe is said to stretch the pipe and distort the holes through which the gas is fed into the basin. Also, it is said that as the pipe is pulled, the sliders may jam on the rail, which may cause the pipe to break and require discontinuing operation of the basin to permit the rest of the pipe to be removed from the basin. The solution described in U.S. Pat. No. 5,290,487 still uses rails secured to the bottom of the basin, and still uses flexible porous pipe. The pipe is not attached directly to the holders, but is free to slide relative to the holders. Also, a separate cable is fed through and attached to each of the sliders, such that force is applied directly to each slider by the cable and not by the pipe. Despite these features, for removal of the pipe, the system described in U.S. Pat. No. 5,290,487 still requires the sliders to ride on the rails while the sliders are in the basin and located in the sludge that settles at the bottom of the basin. As a result, there is still the possibility that the sliders will jam on the rail during an attempt to remove the pipe from the basin. Further, to allow removal of the pipe from the basin, the pipe must still be flexible to allow it to bend at the bottom corner of the basin as it is pulled up out of the basin. Therefore, the system is not applicable to aeration units that use non-porous, rigid pipes.

In another device for aerating liquid in a basin, shown in U.S. Pat. No. 2,328,655, pipes supply air to manifolds in the basin. The pipes are provided with elbows having two sections which rotate to permit the pipes to swing and move out of the basin, carrying the manifolds out of the basin. However, to permit the pipes to clear a stantion of the basin, the swinging method of removing the pipes from the basin limits the length of the pipes.

In another version of a device for aerating liquid in a basin is shown in U.S. Pat. No. 1,195,067. There, no provision is made for removing a rotating pipe or a reciprocating pipe from the basin, other than manually lifting the pipes from the basin.

Sinner et al. U.S. Pat. No. 2,589,882 does not describe a system for moving an aeration unit. Rather, a casket lowering system uses two cables to allow the casket to move down under the force of gravity. The Sinner et al. system includes a fixed carriage that extends across the length and width of an open grave to support pulleys. A reel on the carriage at one end of the grave pays out two separate pairs of cables. One cable extends from the reel, around pulleys on the fixed carriage, and under one end of the casket. The other cable extends from the reel, around other pulleys on the carriage, and under the other end of the casket. As the reel is rotated, the cables pay out uniformly so that both ends of the casket are lowered at the same time. However, in addition to not being designed for moving an aeration unit, the Sinner et al. system requires that the fixed carriage extend all the way across the open grave to position both of the cables under the casket. Further, the carriage is not moved for moving the casket. Rather, the carriage only supports the reel and the pulleys, and both cables pass under the casket. Thus, Sinner et al. do not provide for one cable to move one end of a beam of a frame, and do not transfer force from one end of a movable frame to a second cable to lift an opposite end of the frame.

Applicants' previous system described in the above-referenced parent application provided structure and methods for retrieving an aeration unit from a basin of a water treatment apparatus in a primary which force is applied to the aeration unit from only one side of the basin of the water treatment apparatus. Part of such primary force was vector transferred from one end of a beam of the aeration unit to the other end of the beam to move both ends of the beam. The beam supported pipes of the aeration unit. A force transfer module included one force transfer strand held in a force transfer path between fixed opposite ends of the strand. The force transfer path extended in part along the beam, which was placed in compression during the force transfer. Motion of the one end of the beam resulting from the primary force (e.g., upward or downward motion) was vector transferred by the single force transfer strand to the opposite end of the beam so that both ends of the beam moved in the same upward or downward direction relative to the basin under the action of the primary force.

SUMMARY OF THE PRESENT INVENTION

Applicants continued to study problems related to retrieving aeration units. These studies indicated that servicing of aeration units using the invention of such parent application may be further facilitated by providing compound movement of the aeration unit. In such compound movement, the aeration unit is first vertically removable from the basin, and then the aeration unit, or a section of such unit, is moved (e.g., horizontally) to a position over (or onto) a service area adjacent to the basin to further facilitate servicing of the aeration unit. For ease of description, reference is made to moving the aeration unit "over" (i.e., above) the service area. However, it should be understood that the word "over" includes moving the aeration unit above the service area and then downwardly onto (i.e., resting directly or indirectly on) the service area.

In apparatus of the present invention, various structure may be used to vertically move many types of aeration units from the basin, e.g., a crane or a hoist or the structure described in the above-referenced parent application (which is referred to as a "vector" system. When such above-referenced vector system is used, such compound movement may be facilitated by first applying the primary force to such aeration units from only one side of the basin, and transferring part of such primary force from one end of the beam of the aeration unit to the other end of the beam to move both ends of the aeration unit. The beam supports the pipes of the aeration unit, and the pipes are balanced relative to the axis of the beam. A drive first applies the primary force to one end of the beam of the aeration unit. A single force transfer strand is held in a force transfer path between fixed opposite ends of the strand. The force transfer path extends in part along the beam. Motion of the one end of the beam resulting from the primary force is transferred by the single force transfer strand to the opposite end of the beam, which is placed in compression so that both ends of the beam move relative to the basin under the action of the drive. Such motion of the beam relative to the basin is vertical and first moves the beam and the aeration unit out of the basin. To further facilitate ease and safety of servicing of many types of aeration units, by the present invention further movement of the aeration unit, e.g., movement relative to the beam, is provided to enable the entire aeration unit, or a section thereof, to be positioned over the service area adjacent to the basin. Such service area may be the ground next to the basin, for example. Servicing may involve replacing diffusers secured to the pipes of the aeration unit, or/and adjusting levelling devices which assure that the pipes and the diffusers are level when returned to the basin, and/or replacing the entire section of the aeration unit (e.g., all of the pipes and all of the diffusers). A "serviced aeration unit" may be any of such aeration units. Ease of such servicing is promoted because the service person may stay at the service area to perform the service, and has the choice of simply replacing only certain diffusers or the entire section as a unit.

After servicing, the compound movement process is reversed. The serviced aeration unit is thus first returned to the position on the beam over the basin, and second the beam and the serviced aeration unit are lowered into the basin for further aeration operations.

In still another aspect of this solution to the problems discussed above, an overhead crane is used to lift a structural frame (or platform) that carries an entire section (or many sections) of the aeration unit. The structural frame has opposed guides, such that once the structural frame with the opposed guides is removed from the basin by the crane, the aeration unit section is slid along the guides to a position over the service area.

In still another aspect of this solution to the problems discussed above, another embodiment used with narrow basins provides winches at opposite sides of the structural frame (or platform) that carries the aeration unit section(s). Manual or automatic operation of the winches removes the aeration unit from the basin, and then the aeration unit section is slid along the guides to a position over the service area.

In still another aspect of this solution to the problems discussed above, another embodiment provides the beam of the above-referenced parent application in the form of a truss. The primary force applied to one end of the truss is vector force transferred by a force transfer cable to the other end of the truss. During application of the primary force to the truss, a structural frame attached to the truss is kept level by two vector force transfer cables at each end of the truss and extending laterally along the structural frame. As a variation of this embodiment, the truss can be made to resist torsional forces and only one pair of force transfer cables is used at one end of the truss, e.g. at the service end. Another embodiment is used where the truss is replaced with spaced beams and the primary force is applied to one end of each spaced beam. The two force transfer cables keep the spaced beams level. Another variation provides four winches, one at each corner of a frame, to provide the primary forces to cause the first movement of the compound movement. In each such case, once the primary force(s) have removed the aeration unit from the basin, the second movement of the compound movement is performed to move the aeration unit over the service area.

In a further aspect of the present invention, the beam may be structural pipe that define a rigid structural frame having guides that define saddles. Once the aeration unit has been removed from the basin, the aeration pipes slide on the saddles to be positioned over the service area.

Another aspect of the present invention uses a central truss with a main force transfer cable to provide the first movement of the compound movement. Aeration unit support structure is carried by the truss. Such support structure includes guides on which a movable aeration unit section rides to provide the second of the compound movements.

Methods of the present invention continue the second compound movement after the aeration unit section has been moved to a first position over the service area. The aeration unit is moved to a second position over the service area to make room for another aeration unit section to be moved to the first position, and then onto the guides for opposite first movement onto the support structure. The support structure is then moved in the reverse direction of the first of the compound movements to move the other aeration unit into the basin.

In the various examples noted above, the second motion of the compound motion may be provided by structure on the two or more beams to which the primary forces are applied. Such structure defines a platform. The platform mounts guides, such as a drawer guide. A drawer fixed to pipes of an aeration unit moves along the drawer guide with the aeration unit perpendicular to the first motion, for example. Such perpendicular motion is horizontal when the first motion of the beams and the aeration unit (with its pipes) is vertical. The horizontal motion positions the aeration unit and the pipes off the beams and the platform, over the service area adjacent to the basin. This position is a service position, and is located such that service personnel have easier and safer access to the pipes, to the diffusers, and to the levelling devices, than there would be if the aeration unit were still positioned over the basin, for example. In this manner, the service personnel do not have to climb onto the beams and are not exposed to the risk of falling into the liquid in the basin, for example.

An embodiment of a method of the present invention first moves a platform carrying at least one aeration unit section. The first movement is provided by a cable, winch, or many cables or winches. The first movement is a first of two compound movements, e.g., upward) so that the aeration unit section is removed from a basin. Once the aeration unit section is completely removed from the basin, a second of the compound movements is performed for positioning the aeration unit section at a service position, which is over the service area for maintenance operations, so that the aeration unit section is no longer over the basin.

Another embodiment of the method of the present invention also provides compound motion of the aeration unit. The first motion moves both ends of a platform having a beam, or of a platform having a structural aeration pipe, in a given direction, e.g., vertical (such as out of the basin or into the basin). The method involves a step of providing a force transfer strand with first and second opposite ends and a length that is substantially constant under tension. The flexible force transfer strand is placed in a force transfer (or vector transfer) path with the opposite ends fixed against movement. In use with the beam, the path extends from above one of the ends of the beam and around the one end and along the beam to the other end of the beam and around the other end of the beam and to a fixed point below the other of the ends of the beam. The beam is first moved by applying a primary force to the one end of the beam in the given direction. The primary force is sufficient to move the one end of the beam. As the one end of the beam moves in the given direction, the tension strand vector transfers some of the force in the given direction to the other end, and places the beam in compression, to move the other end in the given direction. Such first motion may be to move the beam, and the aeration unit on the beam, out of the basin to a first position above the upper surface of the liquid in the basin. The second aspect of the compound motion may be provided by causing sliding motion of the pipes of the aeration unit relative to the platform. The sliding motion may, for example, be horizontal (when the first motion is vertical) and results in locating the aeration unit in the service position over the ground of the service area next to the basin. The method may further include levelling the pipes and the diffusers relative to the bottom of the basin, so that upon completion of the retrieval operation with the service pipes and diffusers of the aeration unit back in the basin, a uniform amount of the gas will be ejected from each of the diffusers into the liquid in the basin.

With these and other features of the present invention in mind, it may be understood that the present invention contemplates providing compound movement to an aeration unit, first by a force transfer strand extending in a vector force transfer path relative to an aeration unit which is to be moved first by a drive at one side of the unit, and second by a platform mounting the aeration unit for second movement perpendicular to the first movement.

The present invention also contemplates providing the first motion of an aeration unit via a crane, or winches or by the apparatus of the above-referenced parent application and providing the second motion via sliding the aeration unit off a platform that is over the basin, so that the aeration unit is moved over a service area next to the basin.

The present invention also contemplates use of an overhead crane to lift a platform having a structural frame that carries an entire section (or many sections) of the aeration unit. The platform has opposed guides, such that once the platform with the opposed guides is removed from the basin by the crane, the aeration unit section is slid along the guides to a position over the service area.

The present invention also contemplates an embodiment used with narrow basins, which provides winches at opposite sides of a platform having a structural frame that carries the aeration unit section(s). Manual or automatic operation of the winches removes the platform and the aeration unit from the basin, and then the aeration unit section is slid along guides to a position over the service area.

The present invention further contemplates a method of providing compound motion of a gas pipe (or of a group of gas pipes) of an aeration unit from a basin to a service area at one side of the basin. A first step provides first compound movement upwardly to a platform carrying the gas pipes. Upon first movement of the platform and the pipes out of the basin, the pipes are slid along and off the platform and over a service area.

BRIEF DESCRIPTION OF THE DRAWINGS

Other features and advantages of the present invention will be apparent from an examination of the following detailed descriptions, which include the attached drawings in which:

FIG. 11 is a flow chart showing the steps of the method of the present invention for moving an aeration unit in the first vertical component of the compound movement of the aeration unit relative to a basin;

DETAILED DESCRIPTION OF THE PREFERRED EMBODIMENTS

Aeration Basin 20

Figure 1:
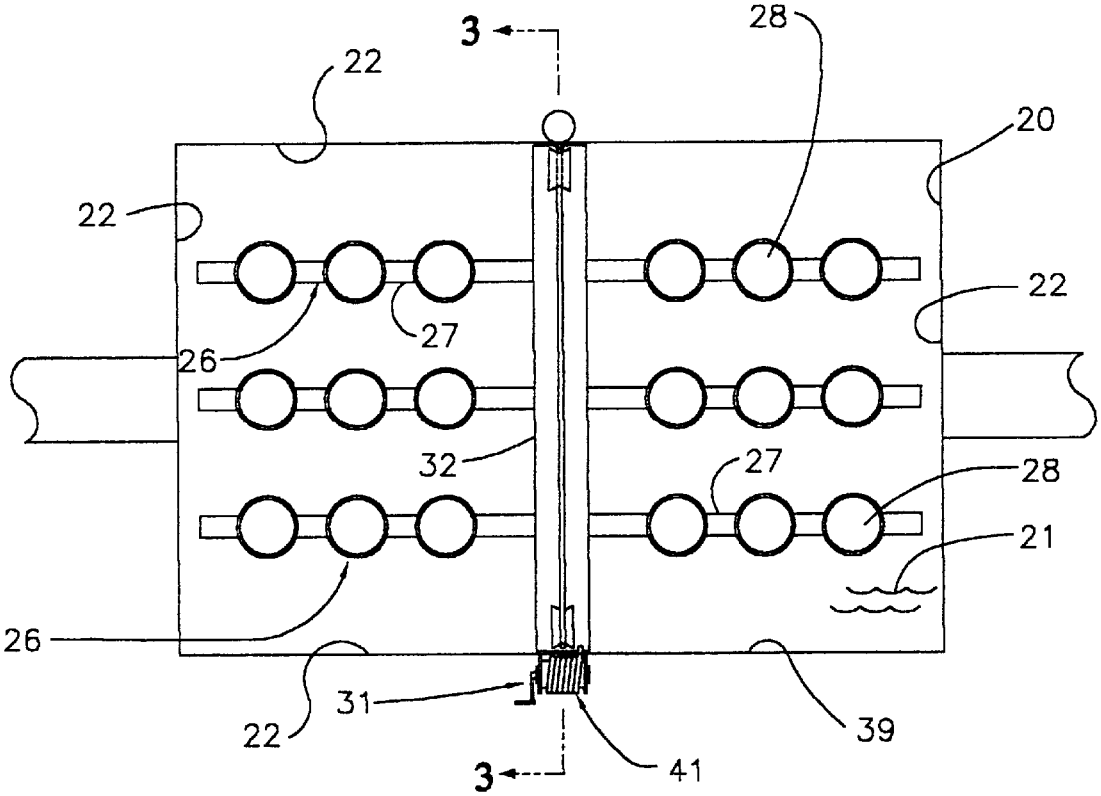
FIG. 1 is a plan view of one aeration unit which covers the whole area of a liquid treatment basin, where the unit includes two aeration pipes which were secured to the bottom of the basin, which pipes according to the present invention have been removed from the bottom and secured to a structural pipe or beam of an aeration unit retrieval device to permit selective retrieval for maintenance, wherein such retrieval device is a vector force transfer device (or system) and provides a first, vertical component of compound movement of the aeration unit.

Referring to FIGS. 1–4, a basin 20 is shown for treating liquid 21, such as by aerating and mixing the liquid 21 to assist in making the liquid 21 suitable for use, reuse, or for further treatment. The liquid 21 may be water or waste water, for example. The basin 20 has vertical outer walls 22, an open top 23 and a bottom 24. The present invention may be used with any shaped basin 20, such as rectangular (shown), or circular or square (not shown).

Aeration Units 26

Aerating of the basin 20 is performed by aeration units 26 which include pipes 27 to supply gas, such as air, to diffusers 28. As an example, the diffusers 28 are shown as hollow disk-shaped outlets which discharge small bubbles (not shown) of the gas into the liquid 21. In the past, the pipes 27 have been secured to the bottom 24 of the basin 20 against the buoyant forces resulting from the gas which fills the hollow pipes 27. One aeration unit 26 is shown in FIG. 1 for aerating the entire area of the basin 20 between the walls 22.

Retrieval Apparatus 31

Figure 2:
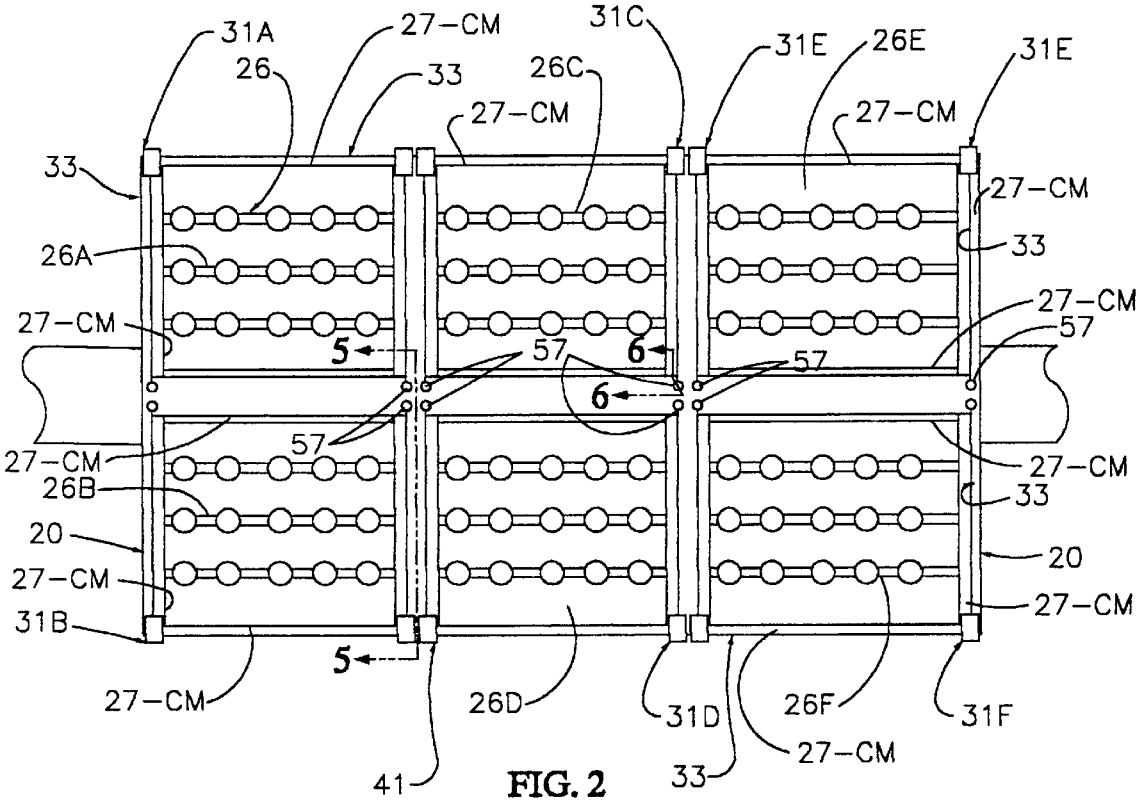
FIG. 2 is a plan view of multiple aeration units, each of which covers only a portion of the area of the liquid treatment basin, wherein according to the present invention pipes of each unit have been structurally designed to support other pipes and carry gas, and wherein the first vertical component of the retrieval is performed separately for each unit without interfering with the operation of the other units.

A retrieval apparatus 31 of the present invention may be used with one aeration unit 26 which aerates the entire area of the basin 20 between the walls 22 (FIG. 1); or with an aeration unit 26 which is divided into many separate sections, e.g., 26A, 26B, etc. as shown in FIG. 2. When the aeration unit 26 is divided into many separate sections 26A, etc., the retrieval apparatus 31 has one section 31A, 32B, etc. for each such section 26A, 26B, etc. of the aeration unit 26. Each section 26A of the aeration unit 26, and each section 31A of the respective retrieval apparatus 31, are separate from the other sections 26B of the aeration unit 26, and from the respective other sections 31B of the retrieval apparatus 31. Thus, one section 26A of the aeration unit 26 may be retrieved and repaired while all of the other sections 26B, etc. of the aeration unit 26 are functional. The retrieval apparatus 31A of the present invention may be used to provide the first of the compound movement of the present invention, e.g., to remove one such section 26A from the basin 20, as by lifting the section 26A upwardly out of the liquid 21 to a first position (dashed lines in FIG. 3) in preparation for second movement rendering such section 26A easily accessible for repair. The same section 31A of the retrieval apparatus 31 may be used to forcefully move the section 26A from the first position back into the basin 20 against such buoyant forces for aeration operation (see FIG. 5).

When a basin 20 already has an aeration unit 26 installed in it, but the unit 26 cannot be adequately retrieved for maintenance, the aeration unit 26 is detached from the bottom 24 and is secured to a structural beam 32 (FIG. 1), or a frame 33 (FIG. 2), of the retrieval apparatus 31. When a basin 20 does not yet have an aeration unit 26 installed in it, but it is desired to have an aeration unit 26 be adequately retrievable for maintenance, the aeration unit 26 is designed integrally with selected parts of the retrieval apparatus as described below.

Retrieval Apparatus 31

As noted above, the terms "retrieval" and "retrieving" are defined as the removal of any type of aeration unit 26 from such basin 20 and the return movement of such aeration unit 26 into such basin 20. In the present invention, apparatus for retrieval may, in the embodiments shown in FIGS. 1–12B, be capable of only a first movement, which for example, is shown as vertical in FIG. 3 and is described with respect to embodiments 31-1, 31-2, 31-3, 31-5, and 31-7 (the "vector" embodiments). Further, apparatus for retrieval may, in the embodiments shown in FIGS. 13A–21E, be capable of both the first movement, which for example, is shown as vertical in FIG. 13B, and the second movement, which for example, is shown as horizontal in FIGS. 13A, 14A, 15A, and 16A. The second movement provides further movement of the aeration unit 26, or of a section 26A, 26B, etc. of the aeration unit 26, during the time period in which the aeration unit 26 (or section 26A) is removed from the basin 20. In embodiments describing the present invention, the second movements of the sections 26A, 26B, etc. result in movement of such sections 26A over a service area 34 (shown in solid-dash-dash-dash lines, e.g., in FIG. 13A) adjacent to the basin 20. Due to the multiple direction nature of such movement, such movement is described as being "compound movement".

In the present invention, the retrieval apparatus 31 having the compound movement capability is identified by the reference "31-C", where "C" denotes "compound". The first movement of the apparatus 31-C may be provided in various ways. For retrieval apparatus 31-C-C shown in FIG. 18, a cable 29 provides the first movement. For the retrieval apparatus 31-C-W shown in FIG. 19, winches 30 provide the first movement. For the retrieval apparatus 31-C-V shown in FIGS. 13A, 13B, 14A, 15A, 16A, and 16B, for example, the vector embodiments provide the first movement.

The second movement of the apparatus 31-C may be provided in various ways, as described with respect to FIGS. 13A, 13B, 14A, 14B, for example, which are referred to as embodiments 31-C-V/D ("vector-drawer"). Also, the second movement may be provided as described in FIGS. 15A, 153, 16A, and 163, which are referred to as embodiments 31-C-V/S ("vector-saddle"). Finally, the second movement may be provided as described in FIGS. 18 and 19, which are referred to as respective embodiments 31-C-C/D ("cable-drawer"), and 31-C-W/D ("winch-drawer").

The elements that provide the respective first and second movements are interchangeable with each other. This is illustrated by the embodiments 31-C-V/S and 31-C-C/D, for example, in which either the vector embodiment or the cable embodiment provides the first movement; and either the saddle or the drawer embodiment provides the second movement.

Embodiment 31-1 of Retrieval Apparatus 31

Figure 3:
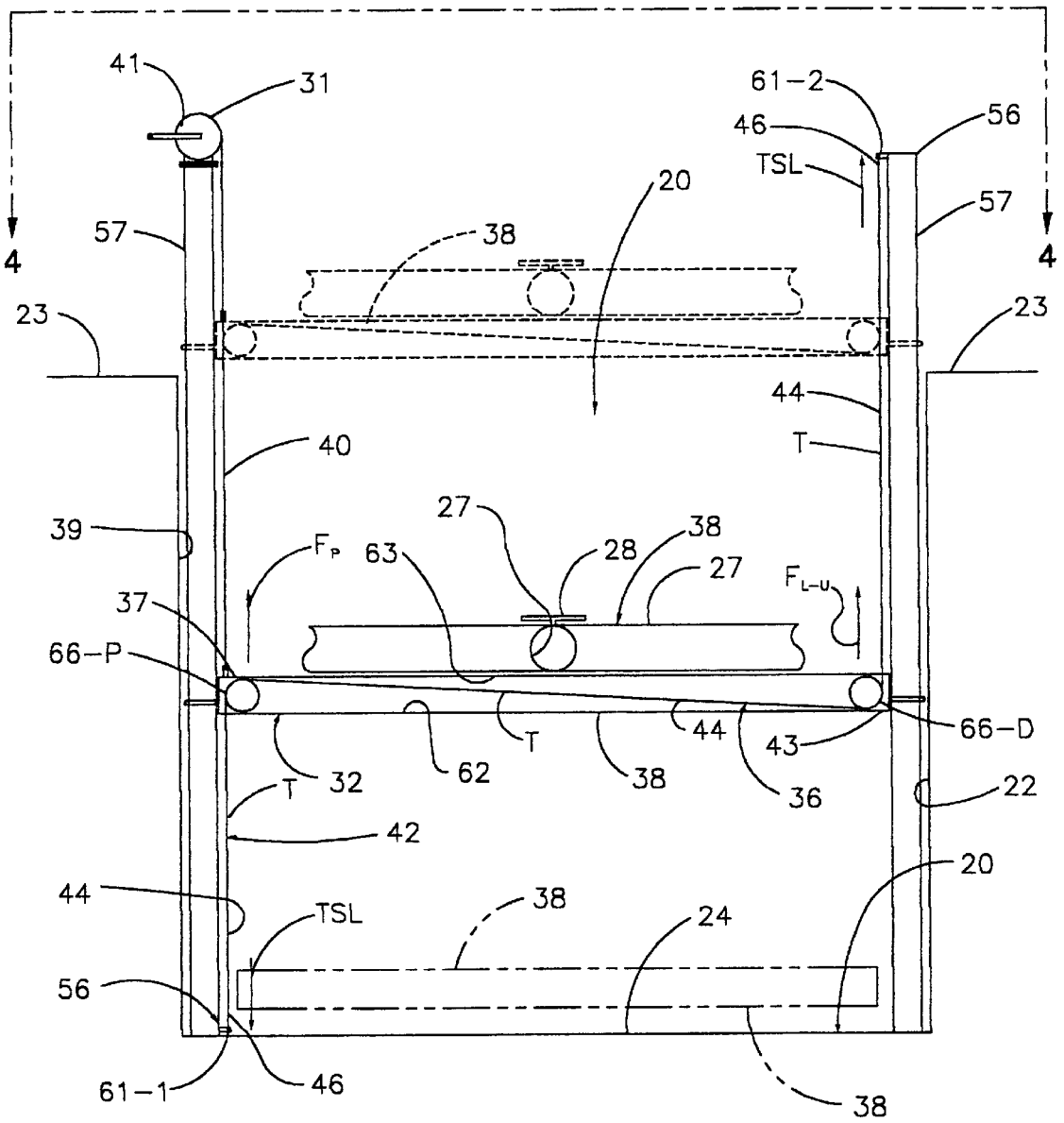
FIG. 3 is a vertical cross section taken along line 3—3 in FIG. 1 showing the retrieval device performing the first component of the retrieval movement, wherein a left end of the structural pipe or beam of the aeration unit is moved up out of the basin by a primary force drive, and a force transfer device transfers some of the primary force to the right end of the beam to place the beam in compression and move the right end up out of the basin to retrieve the aeration unit.
Figure 4:
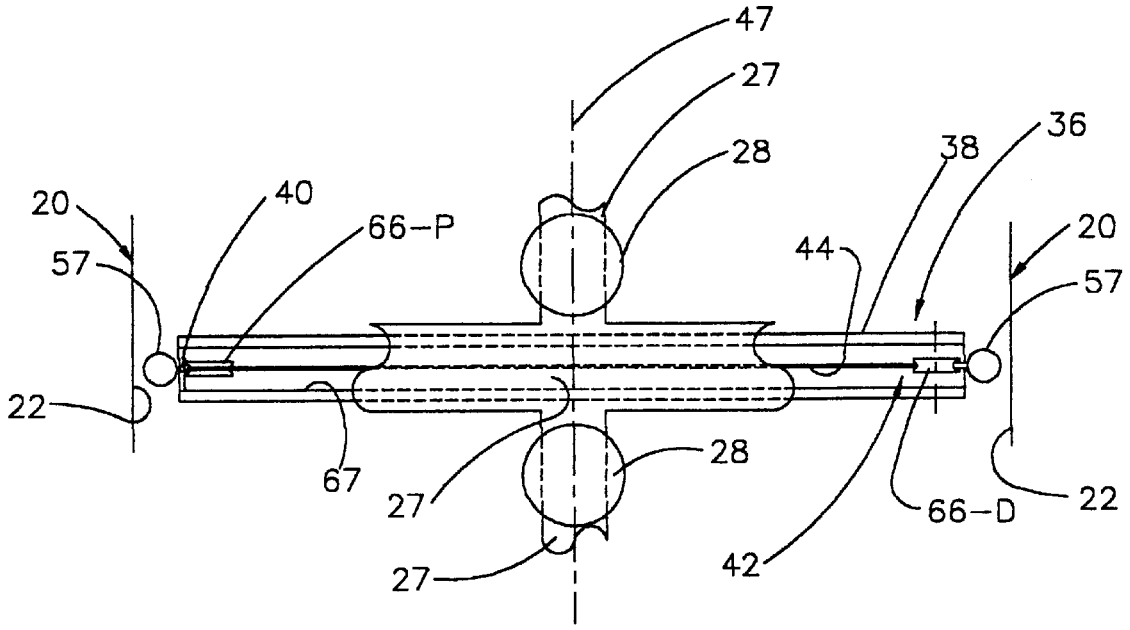
FIG. 4 is an enlarged plan view of a portion of the vector force transfer device shown in FIG. 1, showing a wire rope for applying the primary force directly to the structural beam, and a force transfer strand of the vector force transfer device extending around pulleys on the beam.
Figure 5:
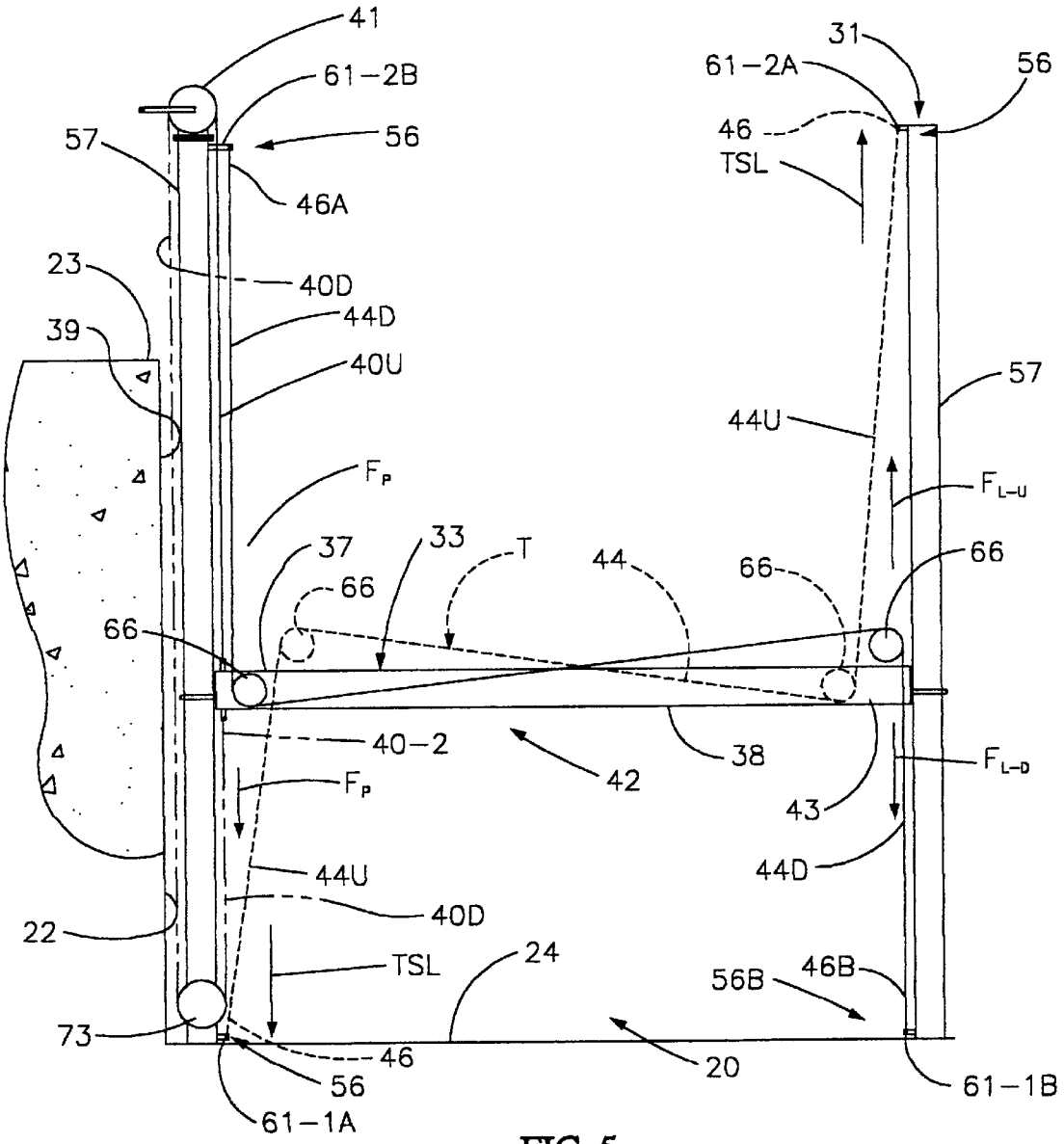
FIG. 5 is a vertical cross section taken along line 5—5 in FIG. 2 showing a left end of a structural pipe of the aeration unit which may be moved up out of the basin, or down into the basin, by a primary force drive at the wall of the basin or down into the basin, and the vector force transfer device transferring some of the primary force to the right end of the pipe, wherein posts hold opposite ends of the force transfer strand of the vector force transfer device and the structural pipe carries pulleys for guiding the force transfer strand.
Figure 8:
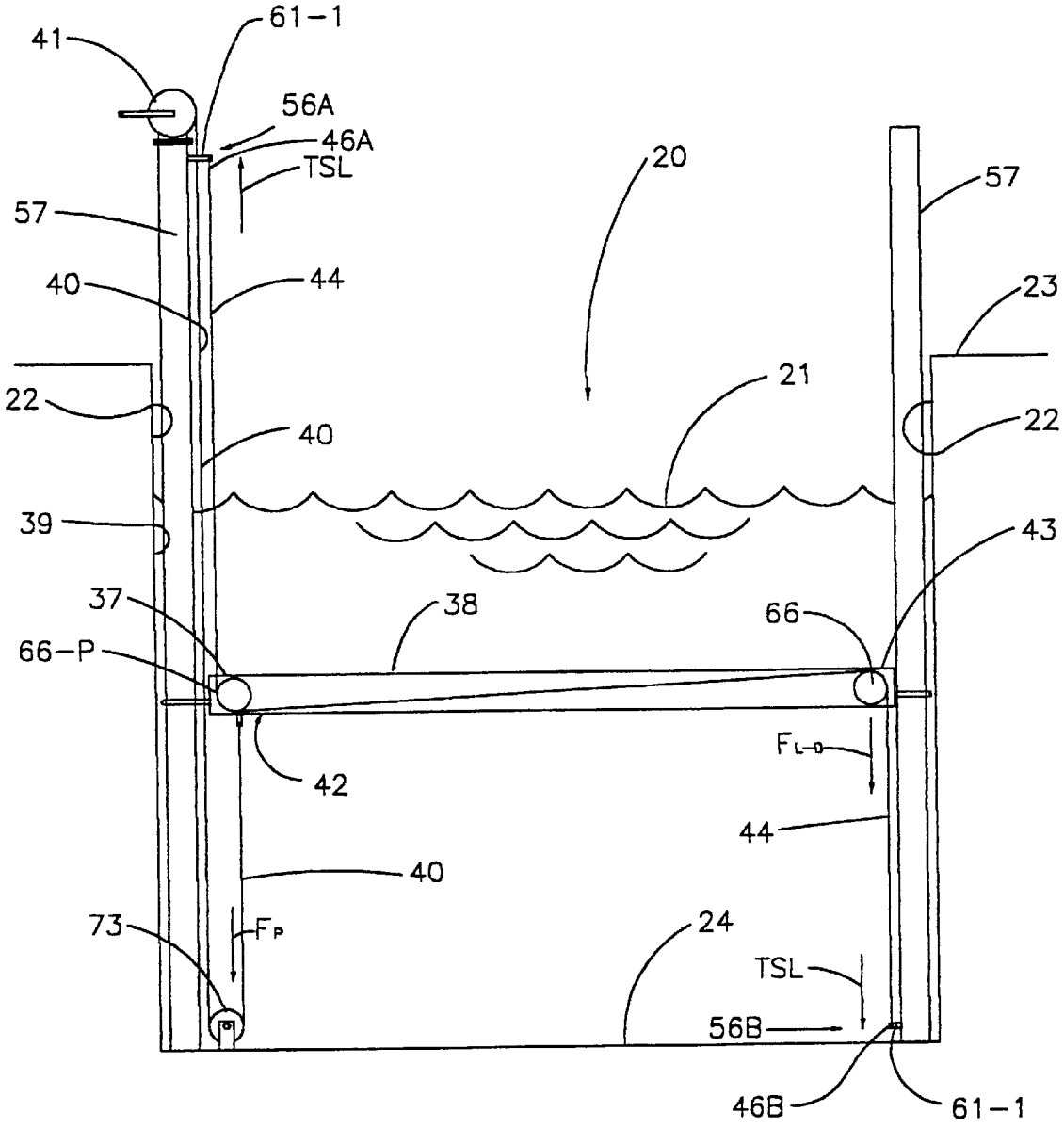
FIG. 8 is a vertical cross sectional view similar to FIG. 3, showing a primary drive used to move an aeration unit into the basin after maintenance.
Figure 9A:
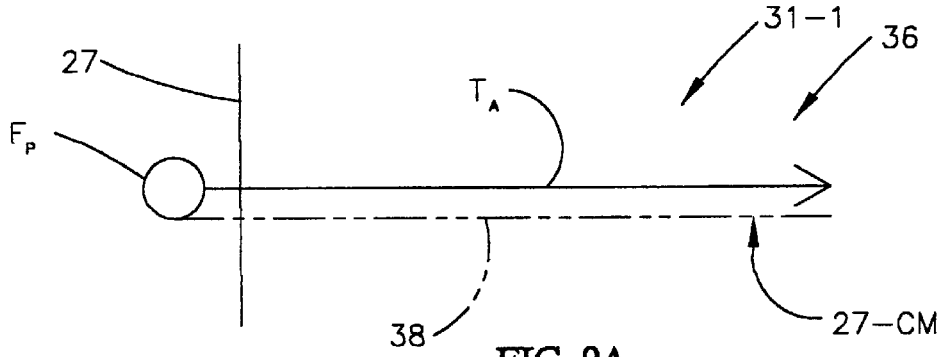
FIGS. 9A through 9G are a series of schematic views showing different embodiments of the first component movement aspects of the present invention, wherein one or two primary forces $F_P$ is/are applied to a structural pipe (shown by a small circle) of an aeration unit, and either one, two or three force transfer strands (shown by the arrows) of the force transfer device transfer part of the primary force(s) $F_P$ to the opposite end (at the arrowhead) of the structural pipe.
Figure 9B:
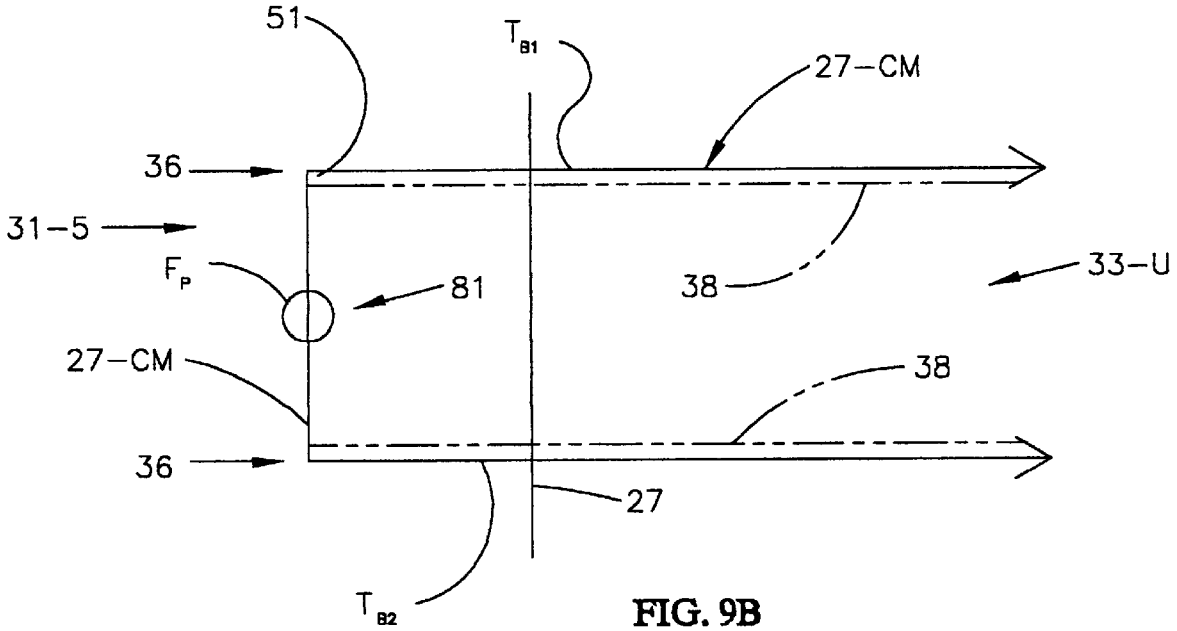
Figure 12A:
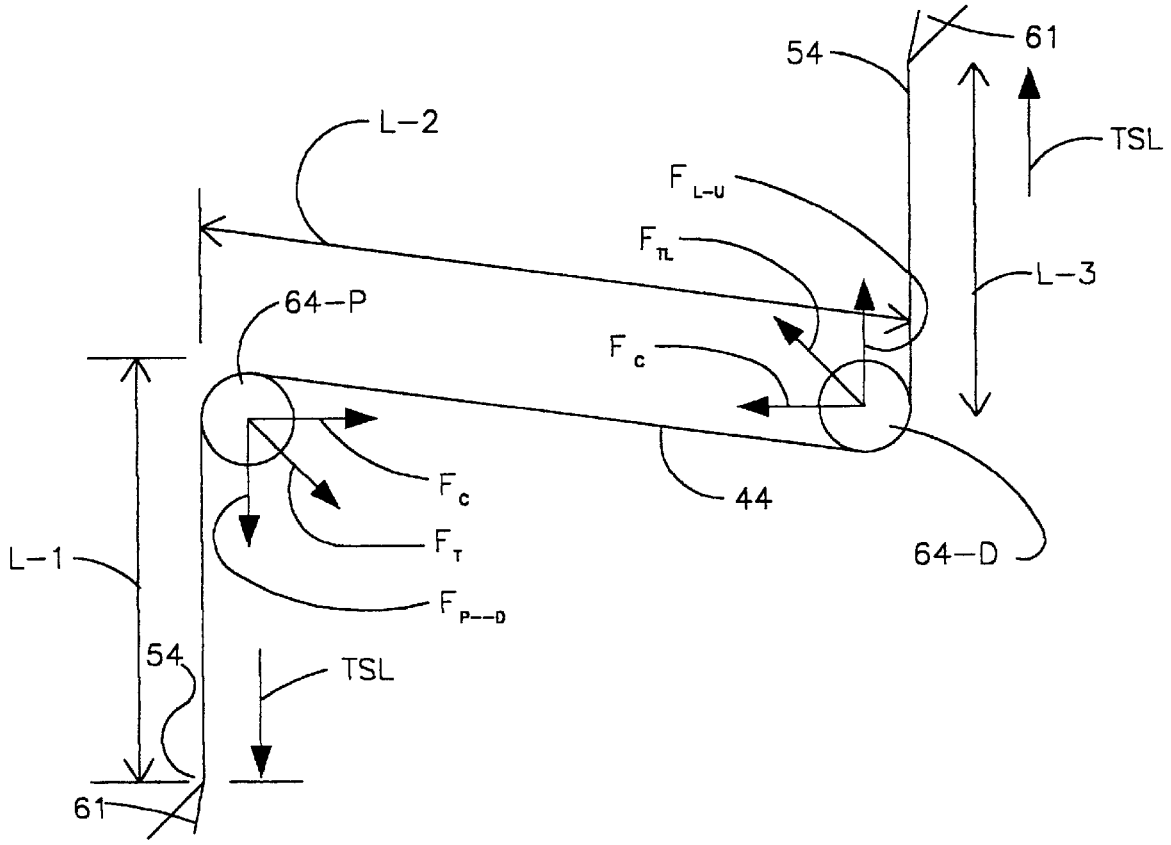
FIG. 12A is a schematic diagram of the force transferred by the force transfer strand shown in FIG. 3, and by one of the force transfer strands shown in FIG. 5.
Figure 12B:
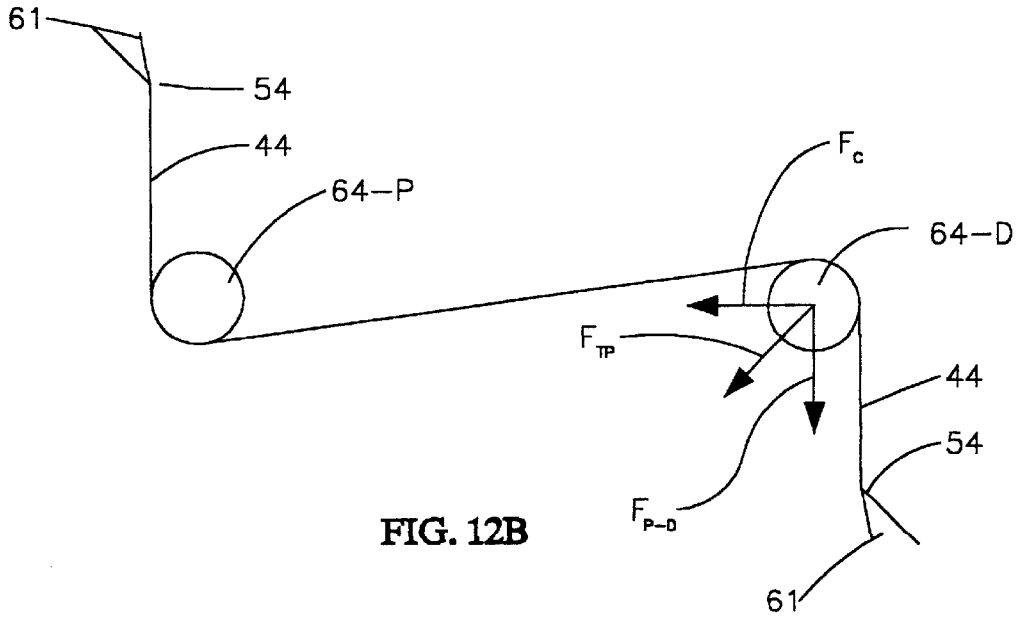
FIG. 12B is a schematic diagram of the force transferred by the force transfer strand shown in FIG. 8, and by one of the force transfer strands shown in FIG. 5.

A basic module 36 of the first embodiment 31-1 of the retrieval apparatus 31 is shown in FIGS. 3 and 4. The module 36 may be used alone as described with respect to FIGS. 9A, 13A, 13B, 14A, and 14B, or in pairs as shown in FIGS. 9B through 9F, or in a group (e.g., with three) modules 36 as shown in FIG. 9G. In each module 36, a primary force $F_P$ is applied to a proximal end 37 of a compression member 38. The compression member 38 may be the beam 32 or a portion of the frame 33 or one of the pipe 27 of such aeration unit 26 (or of a section 26A of such unit 26). The primary force $F_P$ is applied from one side 39 (FIG. 1) of the basin 20. The location of the primary force $F_P$ is schematically shown in FIGS. 9A through 9G, and in FIG. 14A by a small circle adjacent to the "$F_P$" reference number, and in FIGS. 3, 5 and 8 by a force applicator 40 driven by a drive 41. The compression member 38 is schematically shown in FIGS. 9A through 9G by the dash-dot-dot-dash lines, and is shown in FIGS. 13A, 13B, 14A, and 14B, for example, in solid lines. In each module 36, the primary force $F_P$ moves the end 37 of the compression member 38 in the desired direction of the first movement (e.g., up or down relative to the basin 20). In response to the first movement of the end 37 of the compression member 38, in each module 36 a vector force transfer device 42 places the compression member 38 in compression between the end 37 and a distal end 43 and thereby transfers some of the primary force $F_P$ to the distal end 43 as a force $F_T$. The vector force transfer device 42 is shown in FIGS. 3, 5 , 8, 13A, 14A, and 15A as including a single vector force transfer strand 44 held in a force transfer path illustrated by arrows "T" in FIGS. 9A through 9G. The vector force transfer path T extends between fixed opposite ends 46 of the strand 44, and extends in part along the compression member 38. The force transferred to the distal end 43 of the compression member 38 is shown in FIG. 12A as a lifting or retrieval force $F_{TL}$ to describe the force in FIG. 3; and in FIG. 12B as a returning or pull-down force $F_{TP}$ to describe the force in FIG. 8. A vertical component of these respective forces $F_{TL}$ and $T_{TP}$ is shown as a lift-up force $F_{L\text{-}U}$ (FIG. 12A) and a pull-down force $F_{P\text{-}D}$ (FIG. 12B). In FIGS. 3 and 5, the force $F_{L\text{-}U}$ lifts the distal end 43 as the force applicator 40 lifts the proximal end 37, SO the ends 37 and 43 are moved at the same time. A similar result is achieved as shown in FIG. 13B, 14B, 15B, and 16B where the force applicator 40 applies the upward force $F_{L\text{-}U}$ to the compression member 38. In FIGS. 5 and 8, the force $F_{L\text{-}D}$ lowers the distal end 43 as the force applicator 40 lowers the proximal end 37, SO the ends 37 and 43 are moved at the same time.

In FIG. 3, the compression member 38 is in the form of the beam 32 secured and carrying the pipes 27 of the aeration unit 26, such that these pipes 27 need not have structural features. The compression member 38 is balanced relative a longitudinal axis 47 (FIG. 4) of the compression member 38.

Second Embodiment 31-2 of Retrieval Apparatus 31

The basic module 36 of the first embodiment 31-1 of the retrieval apparatus 31 shown in FIGS. 1 and 3 is used with a second module 36 as shown in FIGS. 9B through 9F. Referring to embodiment 31-2 shown in FIG. 9C as an example, many of the modules 36 are used to provide more than one compression member 38 to support the pipes 27 of the aeration unit 26. For clarity of illustration, only one pipe 27 is shown in FIGS. 9A–9G, and such pipe 27 is represented by a single line. The pipes 27 themselves may be hollow, structural compression members 38 and carry the gas, in which case the pipes 27 are referred to as the pipes 27-CM to denote characteristics of the compression members 38.

Figure 9C:
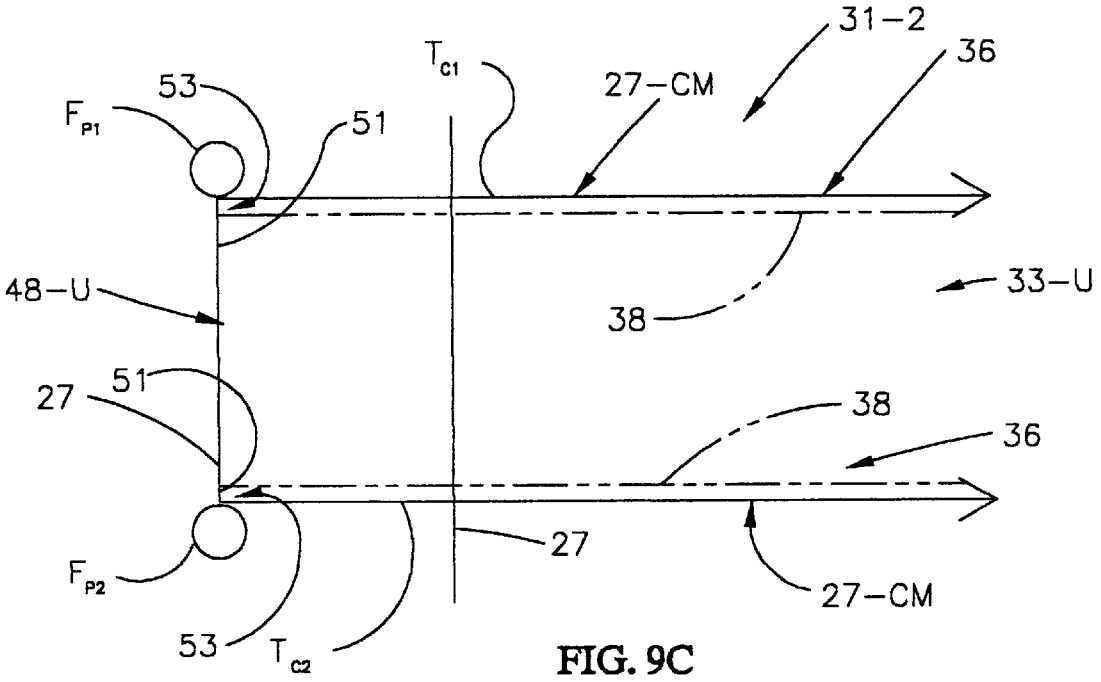

The example of FIG. 9C provides a U-shaped frame 48-U, with the compression members 38 (or the pipes 27-CM) parallel and a pipe 27 between the two compression members 38 (or the pipes 27-CM). The force applicator 41 applies a portion of the primary force $F_P$ directly to each end 37 (FIGS. 3 and %) of each compression member 38. The components of the primary force $F_P$ are denoted $F_{P1}$ and $F_{P2}$ in FIG. 9C, for example.

Each basic module 36 includes the force transfer strand 44 held in the force transfer path T. In the manner described above for the module 36 in embodiment 31-1, each module 36 of the second embodiment 31-2 shown in FIG. 9C is effective to either lift up or pull down the respective compression members 38 (or pipes 27-CM) according to the direction of the first movement (up or down) in which the primary force $F_{P1}$ or $F_{P2}$ is applied to the respective proximal ends 37. Similarly, in FIGS. 13B, 14B, 15B, 16B, and 17B, each module 36 of the embodiment 31-C is effective to either lift up or pull down the respective compression members 38 according to the direction of the first movement (up or down) in which the primary force component $F_{P1}$ or $F_{P2}$ is applied to the respective proximal ends 37.

Frames 48

Figure 9D:
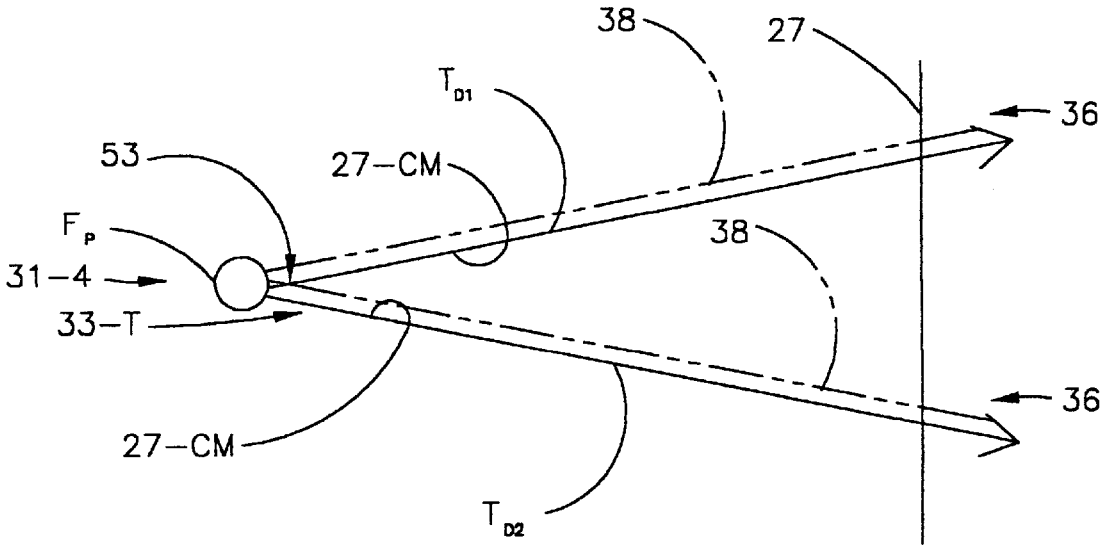
Figure 9E:
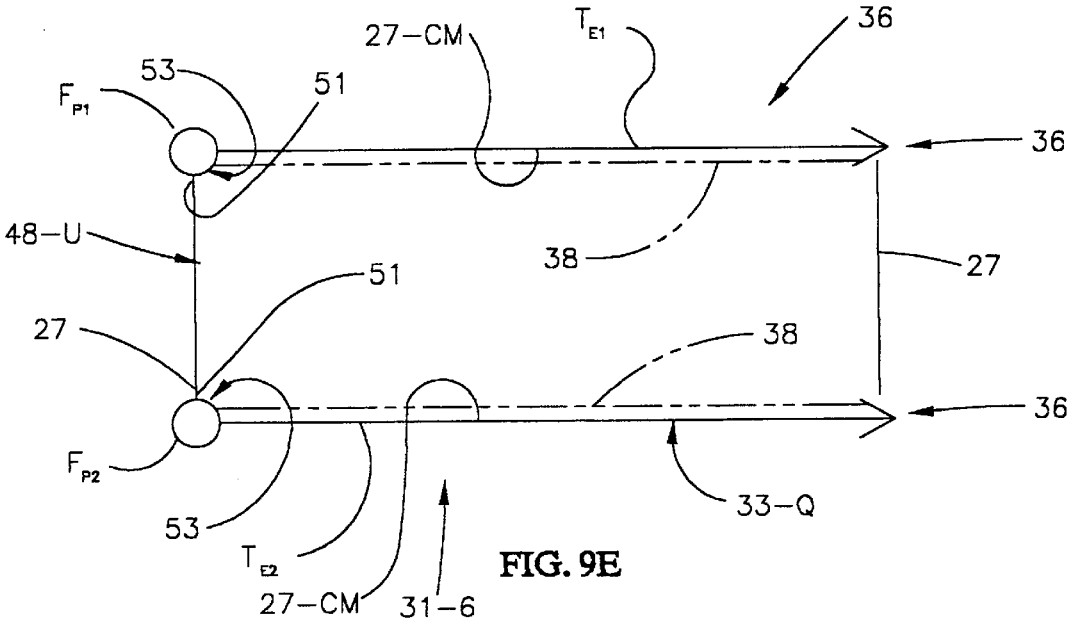
Figure 9F:
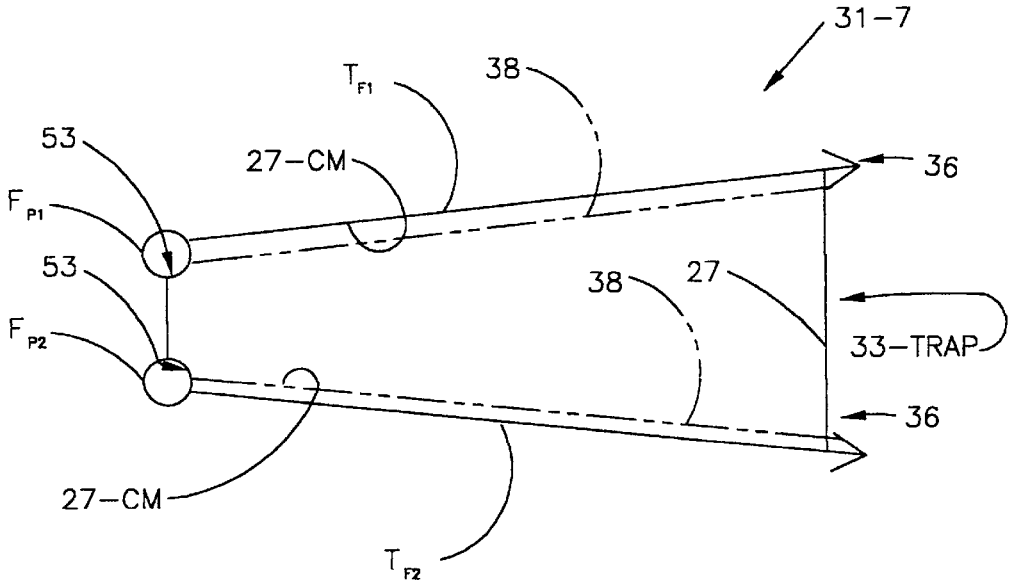
Figure 9G:
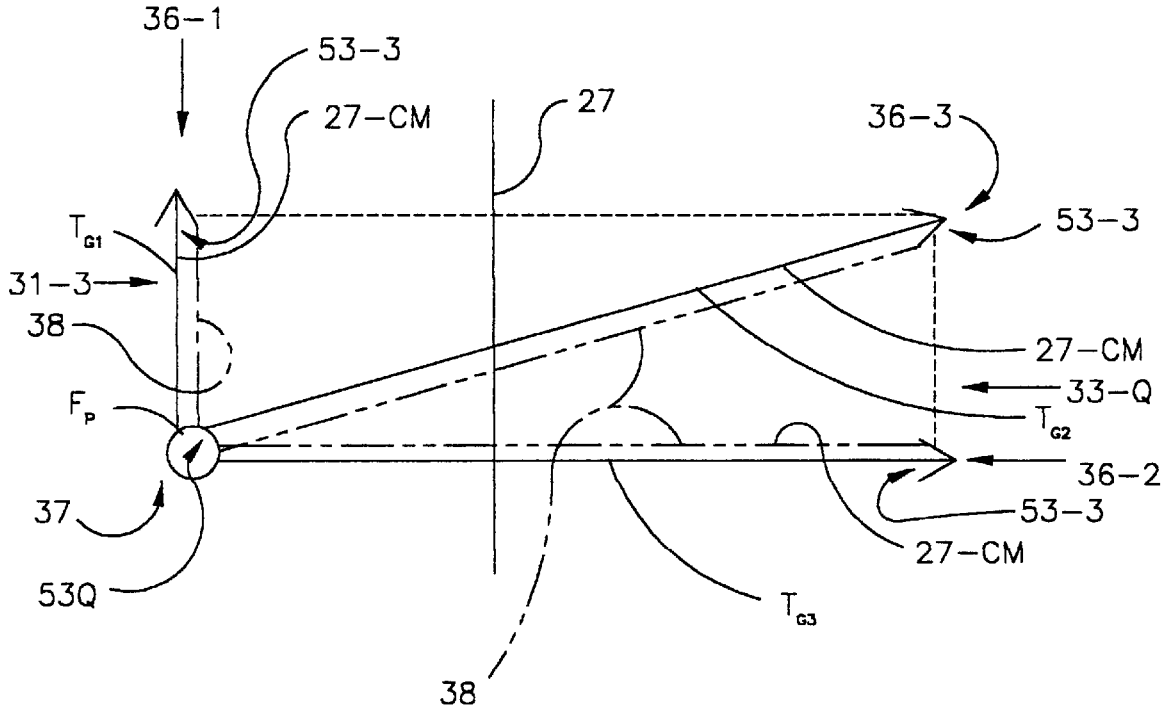

The plurality of structural, gas carrying pipes 27-CM, or the many compression members 38, may be connected in a triangular shape as shown in FIG. 9D (and referred to as a triangular frame 33-T) or in a quadrilateral shape having four sides as shown in FIGS. 9E and 9G (and referred to as a quadrilateral frame 48-Q). In either case, the shape is referred to as the frame 33, the sides of which define a closed perimeter. For aeration units 26 used in a circular basin (not shown), the quadrilateral shape may, for example, be trapezoidal as shown in FIG. 9F, which is referred to as a frame 33-TRAP. For aeration units 26 used in a square or rectangular basin 20, for example, the quadrilateral shape may be square, or rectangular as shown in FIG. 9G, which may also be referred to as a frame 33-R.

A corner 53 of the triangular frame 48-T, or one or more corners 53 of the quadrilateral frame 48-Q, is/are defined by the pipes 27-CM, or by the compression member 38. The force applicator 41 is connected to such corner 53 to apply the primary force $F_P$ to the corner 53. The primary force $F_P$ applied to the corner 53 moves each adjacent compression member 38, or pipe 27-CM, that forms the corner 53. As an example, an embodiment 31-3 has the quadrilateral frame 33-Q shown in FIG. 9G. One corner 53Q is the place at which the primary force $F_P$ is applied. Three modules 36 extend from that corner 53Q. Each module 36 includes one compression member 38 (shown by dash-dot-dot-dash lines) and one force transfer strand 44 (FIG. 5) in the force transfer path T (as shown by the arrows $T_{G1}$, $T_{G2}$, and $T_{G3}$). In the manner described above for the module 36 of embodiment 31-1, each module 36 of embodiment 31-3 of the retrieval apparatus 31 shown in FIG. 9G is effective to either lift up or pull down the respective compression members 38 (or pipes 27-CM) according to the direction (up or down) in which the primary force $F_P$ is applied to the corners 53Q. As shown in FIG. 5 with respect to one compression member 38, the distal ends 43 of the three compression members 38 (i.e., the ends 43 that are away from the common corner 53Q at the proximal end 37) are lifted or pulled down according to the direction of the force $F_P$ applied to the proximal end 37.

Method of Providing First Movement of Aeration Units 26

One aspect of the method of the present invention is providing the first movement. As shown in FIG. 11, one aspect of the first movement involves a step 100 of providing the flexible force transfer strand 44 of the module 36. Referring also to FIGS. 12A and 12B, the strand 44 has first and second opposite ends 46 and a total strand length TSL (shown in FIGS. 3, 5 and 8 between the arrowheads of two spaced arrows TSL) that is substantially constant under tension. In step 200 the flexible force transfer strand 44 is placed in the force transfer path T with the opposite ends 46 of the strand 44 fixed against movement. In reference to the module 36 shown in FIG. 3, the force transfer path T extends from a fixed point 56 above one of the ends of the compression member 38 (e.g., the end 43) and around the end 43 and along the compression member 38 to the other (proximal) end 37 of the compression member 38 and around that end 37 and to another fixed point 56 below the proximal end 37. In step 300, the compression member 38 is moved by applying the primary force $F_P$ to the proximal end 37 of the compression member 38. The primary force $F_P$ is sufficient to move the proximal end 37 of the compression member 38. As the proximal end 37 of the compression member 38 moves in the given direction (shown as up in FIG. 3), in step 400 the force transfer strand 44 transfers some of the primary force $F_P$ to the distal end 43 as the transferred force $F_T$, and places the compression member 38 in compression (via the transferred force $F_C$), to thereby use the force $F_{L\text{-}U}$ to move the distal end 43 in the given direction of the first movement (e.g., up in FIG. 3).

Each of the vector force transfer embodiments 31-C shown in FIGS. 13A, 13B, 14A, 14B, 15A, 15B, 16A, 16B, 17A, and 17B performs the above method shown in FIG. 11 to provide such first movement.

Detailed Description of Module 36

Figure 7:
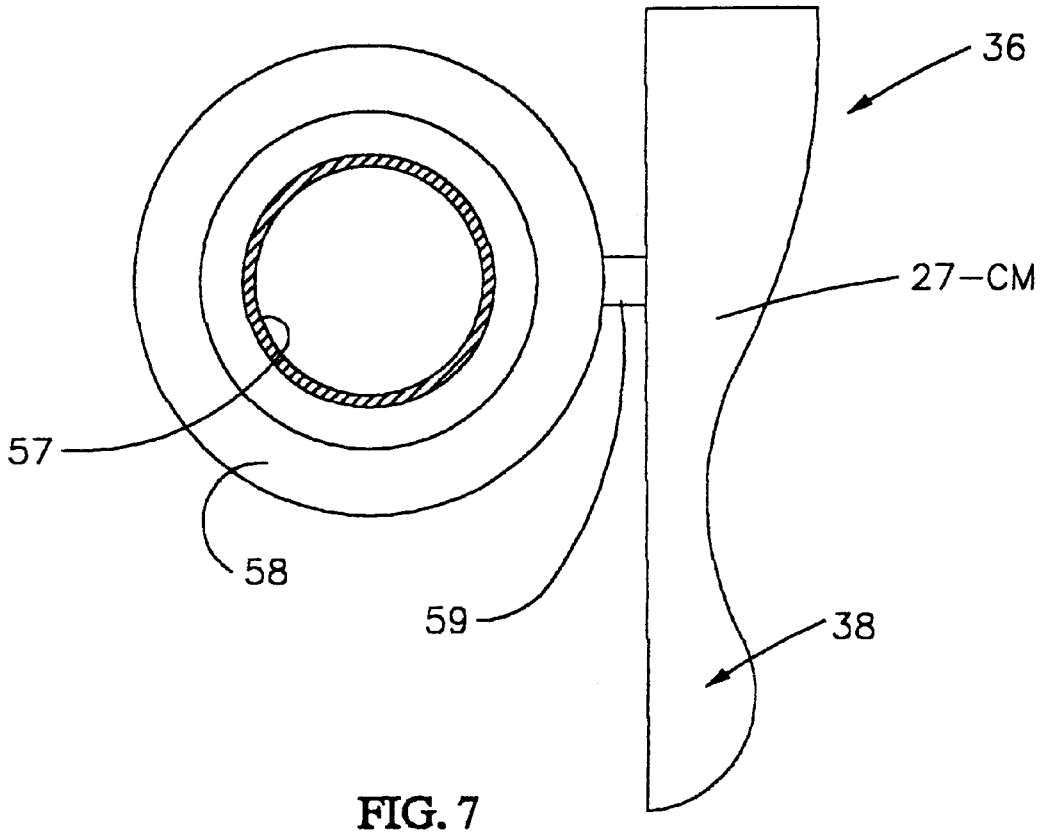
FIG. 7 is a cross sectional view taken along line 7—7 of FIG. 6 showing a ring-shaped guide around the post, the ring is being secured to one of the aeration units.
Figure 6:
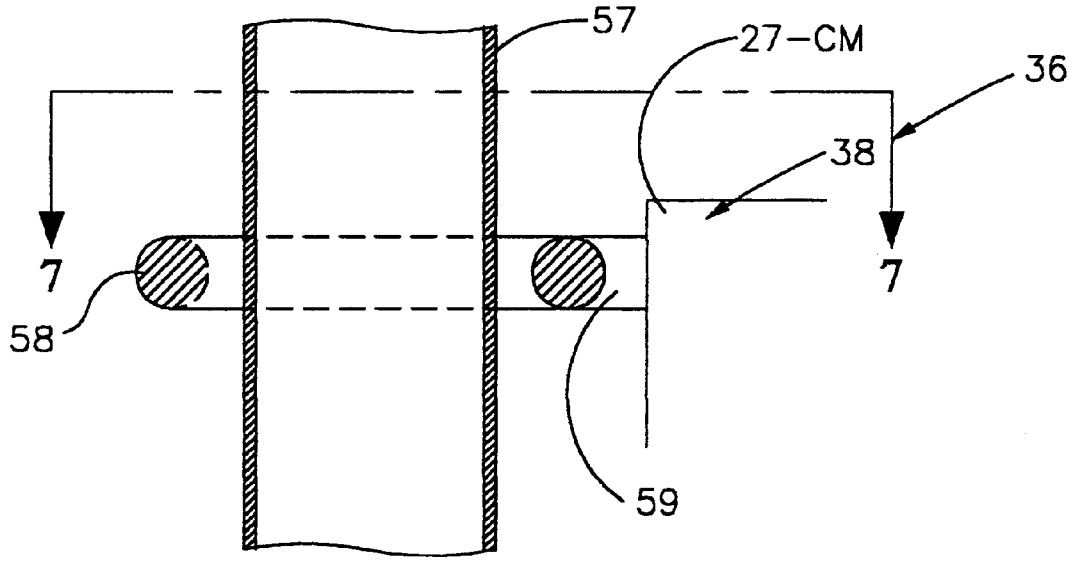
FIG. 6 is an elevational view taken on line 6—6 of FIG. 2, showing one of the posts shown in FIG. 5, illustrating how the post guides the aeration unit.

In greater detail, the module 36 may be used to provide the first movement in either of the two opposite directions (shown as up or down in FIGS. 3, 5, 13B, 14B, 15B, 16B, and 17B). For economy of description, first movement upwardly out of the basin 20 is described in connection with FIGS. 3 and 5, and then the reverse first movement is briefly explained in connection with FIGS. 5 and 8. The aeration unit 26 shown in FIGS. 1 and 3 has the compression member 38 as one main support. The compression member 38 extends horizontally across the basin 20, and has loads reasonably balanced from side to side along the length of the beam (e.g., along the longitudinal axis 47 shown in FIG. 2). As shown in FIGS. 6 and 7, posts 57 are provided at opposite ends of the compression member 38 as shown in FIGS. 3 and 5 to guide the vertical movement of the compression member 38. A ring surrounds the post 57 and is connected to the compression member 38 by an arm 59.

When the aeration unit 26 is to be moved for repair, as by first movement up, out of the basin, 26 it is desirable to have the first movement of the proximal end 37 and the distal end 43 of the compression member 38 be generally at the same time. The retrieval apparatus 31 shown in FIGS. 3 and 8, and the retrieval apparatus 31-C-V shown in FIGS. 13A, 13B, 14A, 14B, 15A, 15B, 16A, 16B, 17A, and 17B apply an external force in a given direction (e.g. upwardly) only to the proximal end 37, yet both of the ends 37 and 43 move out of the basin 20 generally at the same time. The external force is the primary force $F_P$ The force applicator 40 is provided for applying the (external) primary force $F_P$, or the components $F_{P1}$ and $F_{P2}$ , to the proximal end 37 of the compression member 38 of the aeration unit 26 to move the proximal end 37 upwardly in the basin 20 in this example. The force applicator 40 is driven by the drive 41, which may be a hydraulic or pneumatic drive, or a motor driven drive, such as a reel. In FIGS. 1, 5, 8, 13A, 13B, and 17B the drive 41 is shown as a hand operated winch 41. The winch 41 is mounted above the near wall 22 of the basin 20 (the side 39 or left wall 22 in FIG. 3) so that it is near the operator, or near controls (not shown) used by the operator. Whether hand operated or motor driven, the winch 41 takes up and pays out the force applicator 40, which may be a ¼ inch stainless steel wire rope for loads of up to 5000 pounds, or may be two parallel stainless steel bands, each having a two inch width and a ten mil thickness, for example.

Still referring to FIGS. 12A and 12B, the vector force transfer device 42 is responsive to the first movement of the proximal end 37 of the compression member 38 to transfer some of the (external) primary force $F_P$ to the second (distal) end 43 of the compression member 38 to move the distal end 43 in the first movement as the proximal end 37 moves. The vector force transfer device 42 includes first and second fasteners 61, such as clips or retainers. A first clip 61-1 is at one of the fixed locations 56 relative to the basin 20, generally vertically aligned with the proximal end 37 of the compression member 38 and on one side 62 (e.g., the low side) of the compression member 38, opposite to the other side 63 (e.g., the high side) which is the side to which the drive 41 applies the (external) primary force $F_P$ to the compression member 38. The second clip 61-2 is at the other fixed location 56 relative to the basin 20, generally aligned with the distal end 43 of the compression member 38 and on the other side 63 (the high side) of the compression member 38. A guide 66, such as a roller or pulley, is provided at each of the proximal end 37 (guide 66-P) and distal end 43 (guide 66-D) of the compression member 38, as in a slot 67.

The force transfer device 42 also includes the elongated flexible force transfer strand 44 having the opposite ends 46 connected to respective ones of the first and second fixed clips 61-1 and 61-2 and extending over the guides 66-P and 6-D in the force transfer path T. Such strand may be a chain, a wire rope, or a band. For example, one of the above-described stainless steel bands may be used. The total strand length TSL is substantially constant under tension in the force transfer path T. With the primary force $F_P$ supporting the proximal end 37 of the compression member 38 as such force $F_P$ starts to move the end 37, the lower end 46 of the force transfer strand 44 is fixed (secured to the clip 61-1) and the strand 44 extends along a variable-length section L-1 to and around the pulley 64-P. The remainder of the TSL of the strand 44 is a constant-length section L-2 and a variable-length section L-3. The distal end 43 is suspended on the sections L-2 and L-3 of the strand 44. As described above, the vertical component $F_{L-U}$ of the transferred force $F_T$ that the strand 44 transfers to the distal end 43 of the compression member 38 lifts the distal end 43 as the drive 41 lifts the proximal end 37. As this lifting occurs, the variable-length L-1 increases. Because the length L-2 is constant, the length L-3 must decrease, and the decrease occurs via the described lifting of the distal end 43.

Figure 10:
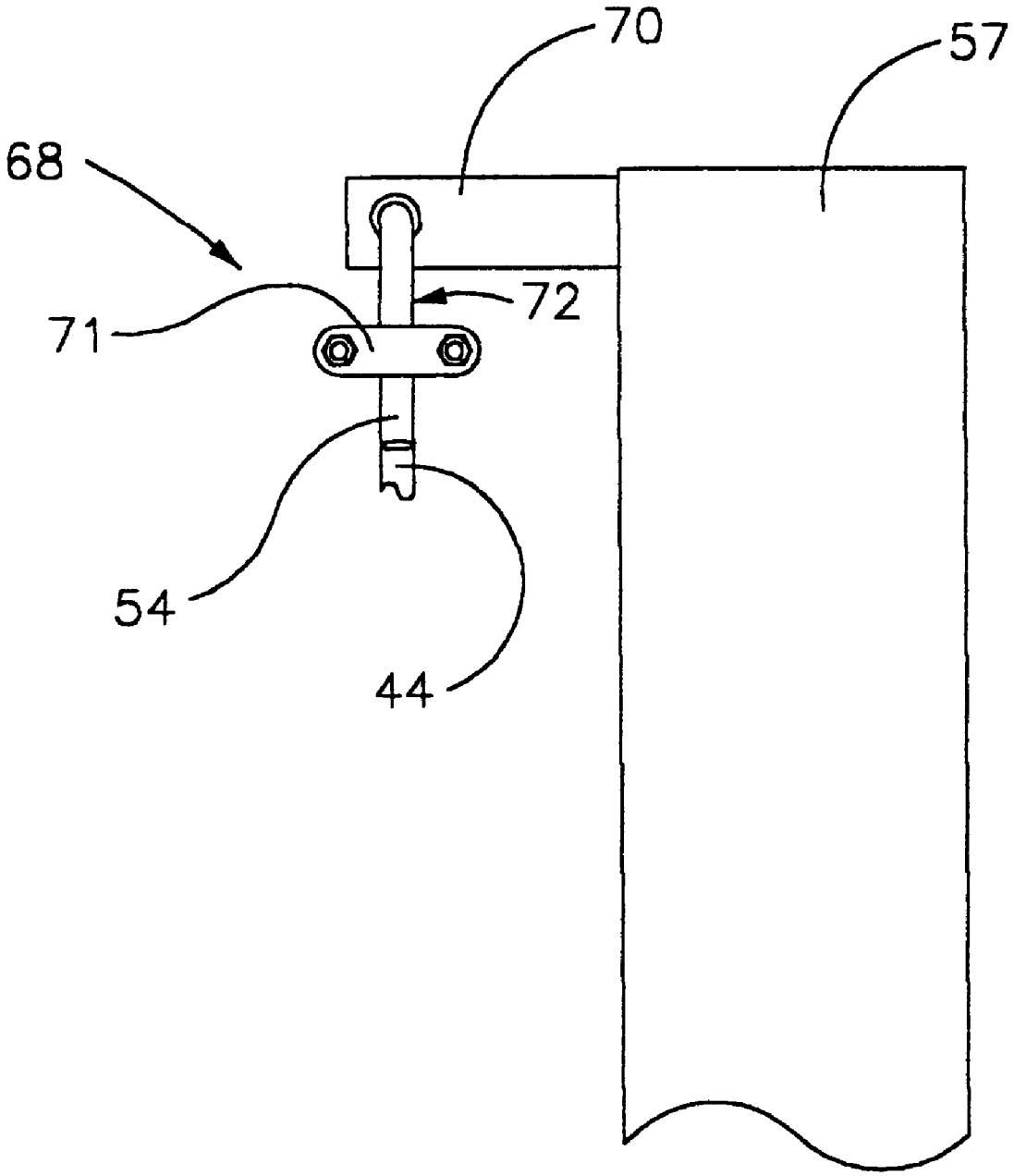
FIG. 10 is an elevational view of a clamp which is used to adjust the operating length of the force transfer strand to level the aeration unit.

The fixed point 56 of the strand 44 is fixed during the first movement for retrieval of the aeration unit 26. However, an adjuster 68 is provided for adjusting the TSL length of the strand 44 between brackets 70 which are fixed to the posts 57 instead of the clips 61. Referring to FIG. 10, the adjuster 68 is shown including a clamp 71 for holding a loop 72 of the strand 44. The end 54 of the strand 44 extends through a hole in the bracket 70. Adjustment of the clamp 71 permits lengthening or shortening of the TSL length of the strand 44. With the force applicator 40 held fixed by the drive 41, adjustment of the clamp 71 and such lengthening or shortening enables the compression member 38 to be leveled to facilitate even flow of gas from the pipes 27 or 27-CM.

First Movement of Aeration Unit 26 into Basin 20

Some liquid treatment units 26 are buoyant and have to be pulled into the liquid 21 for aeration operation. The retrieval apparatus 31 may also be used to provide the first movement by moving the compression member 38 downwardly into the basin 20 against the buoyant force. Referring to FIG. 8, it may be understood that the same retrieval apparatus 31 may be used for the first movement of the compression member 38 downwardly into the basin 20 against the buoyant force. Also, in FIG. 5, a dual direction first movement version of the drive 41 may be used to move the compression member 38 downwardly into the basin 20 against the buoyant force, or upwardly as described with respect to FIG. 3. The direction of the force $F_P$ applied to the proximal end 37 is reversed by extending the applicator 40 around a pulley 73 secured to the wall 22 of the basin 20. The pulley 73 reverses the direction in which the force transfer strand 44 applies the primary force $F_P$ to the proximal end 37. Also, the end 46A of the strand 44D on the drive side (left side 39 in FIG. 8) is secured out of the liquid 21 at the fixed point 56A, whereas the end 46B of the strand 44 opposite to the drive side (right in FIG. 8) is secured at the fixed point 56B in the liquid 21 near the bottom 24. Based on the description above, the operation of pulling the aeration unit 26 down into the basin 20 may be understood.

Retrieval Apparatus 31 for Section 26A of Aeration Unit 26

Posts 76

As described above, retrieval apparatus 31 of the present invention may be used with an aeration unit 26 which is divided into many separate sections, e.g., 26A, 26B, etc. as shown in FIG. 2. The retrieval apparatus 31 has one section 31A, 32B, etc. for each such section 26A, 26B, etc. of the aeration unit 26. The retrieval apparatus 31A, etc. for the respective sections 26A, etc. of the sectionalized aeration units 26A, 26B, etc., is virtually the same as that described above in connection with FIGS. 1 and 3. As shown in FIGS. 2 and 5, one of the posts 57 is mounted on the bottom 24 of the basin 20 and extends upwardly out of the basin 20. The posts 57 are hollow cylinders, for example. The posts 57 guide the rings 58 for the same vertical movement of the compression members 38 of the retrieval apparatus 31A, 31B, etc. as the posts 57 guide the rings 57 for vertical movement of the compression members 38 of the retrieval apparatus 31 shown in FIGS. 1 and 3. The posts 57 mount the clips 61-2A and 61-2B at the fixed point 56 out of the liquid 21 as shown in FIG. 5. The drive 41 shown in FIG. 5 may be the shared reel drive which is described in U.S. Pat. No. 5,655,727 issued Aug. 12, 1997, and entitled Sludge Collector Method and Drive With Shared Reel For Taking Up and Paying Out Cables, which is incorporated herein by this reference. That drive 41 drives the force applicator 40 in opposite directions according to the direction in which the winch is rotated. During the vector force transfer operation of the strand 44, the force $F_P$ may thus have either direction shown in FIG. 5. In each case, the force $F_C$ (FIGS. 12A and 12B) is counteracted by the compression member 38 which resists the compressive force $F_P$. Further, the frames 33 laterally stabilize the posts 57 during the removal and return operations.

First Movement of the Various Frames 48

Triangular Frame 48-T

As described above, the modules 36, with the plurality of structural, gas-carrying pipes 27-CM, or the many compression members 38, may be connected to form the triangular frame 33-T shown in FIG. 9D. Based on the description of the modules 36, it may be understood from FIG. 9D that two modules 36 are used in an embodiment 31-4 of the retrieval apparatus 31 shown in FIG. 9D. The corner 53 is between the two modules 36. To provide the first movement, the primary force $F_P$ applied to the corner 53 moves each adjacent compression member 38, or pipe 27-CM, that forms the corner 53. Two force transfer paths $T_{D1}$ and $T_{D2}$ transfer the primary force $F_P$ to the distal ends 43 of each of the compression members 38 (or pipes 27-CM), and the distal ends 43 move as described above with respect to FIGS. 3 and 9A.

Variation of U-Shared Frame 48-U

A variation of the embodiment 31-2 of the retrieval apparatus 31 is shown as an embodiment 31-5 in FIG. 9B, and also provides the U-shaped frame 33-U. Such frame 33-U has the compression members 38 (or the pipes 27-CM) parallel and a center pipe 27-CM between the two compression members 38 (or the pipes 27-CM). The drive 41 applies the primary force $F_P$ to a midpoint 81 of the center pipe 27-CM. The center pipe 27-CM transfers the primary force $F_P$ to the respective ends 51 of the center pipe 27-CM. The ends 51 are connected directly to each proximal end 37 of the compression members 38 that are connected to the center pipe 27-CM. The operation of the embodiment 31-5 of the retrieval apparatus 31 is thereafter the same as the operation of the embodiment 31-2 of the retrieval apparatus 31 as described above with respect to FIG. 9C.

Quadrilateral Frame 48-0

The quadrilateral frame 33-Q has four sides as shown in FIGS. 9E and 9G. In either case, the perimeter of the frame 48-Q is closed. The difference between the quadrilateral frame 48-Q of an embodiment 31-6 (FIG. 9E) of the retrieval apparatus 31, and the U-shaped frames 49-U of embodiments 31-2 and 31-5, is that in embodiment 31-6 (FIG. 9E) a pipe 27 is provided between the opposite distal ends 43 of the compression members 38, whereas no such pipe 27 is provided in the U-shaped frames 33-U shown in FIGS. 9B or 9C. Thus, the operation of embodiment 31-6 (FIG. 9E) may be understood from the above description of FIG. 9C (embodiment 31-2).

Another version of the quadrilateral frame 33-Q is shown in FIG. 9F as embodiment 31-7 for a circular basin 20 (not shown). The circular basin 20 has circular outer walls 22, such that the aeration apparatus 26 is in sections 26A, 26B, etc. Each section 26A, etc. has the trapezoidal frame 33-TRAP shown in FIG. 9F, so that multiple frames 33-TRAP combine to position the pipes 27, or the pipes 27-CM, to aerate all of the area of the circular basin. The sections 26A, etc. having the trapezoidal frames 33-TRAP are the same as the other quadrilateral frames 33-Q in that the perimeter of the frame 33-TRAP is closed. The difference between the quadrilateral frame 33-Q of embodiment 31-6 (FIG. 9E) and the trapezoidal frames 33-TRAP of embodiments 31-7 is that in embodiment 31-7 (FIG. 9F) the pipe 27 on the right side of the frame 33-TRAP is longer than the corresponding pipe 27 of embodiment 31-6 (FIG. 9E). The operation of embodiment 31-7 (FIG. 9F) may be understood from the above description of FIGS. 9C (embodiment 31-2) and 9E.

In embodiment 31-3 (FIG. 9G), the quadrilateral frame 48-Q has the corner 53Q defined between one module 36-1 and a second module 36-2 at right angles to the module 31-1. Also, a third module 31-3 extends diagonally across from the corner 53Q to a corner 53-3. Preferably, the diagonal of the third module 36-3 includes a compression member 38. Based on the description of the one module 36 above in re FIG. 9A, it may be understood that in embodiment 31-3 one third of the primary force $F_P$ is transferred from the corner 53Q into each of the three modules 36-1, 36-2 and 36-3, to the respective corners 53-1, 53-2 and 53-3. Each such corner 53-1, 53-2, and 53-3 is moved as the primary force $F_P$ moves the proximal end 37 of each such module 36-1, 36-2, and 36-3.

Compound Movement Embodiments 31-C

The compound movement embodiments 31-C of the present invention include many of the same features as those described in the above-identified parent application. Those features are described below using the same reference numbers as are used above.

Service Area 34

Figure 13A:
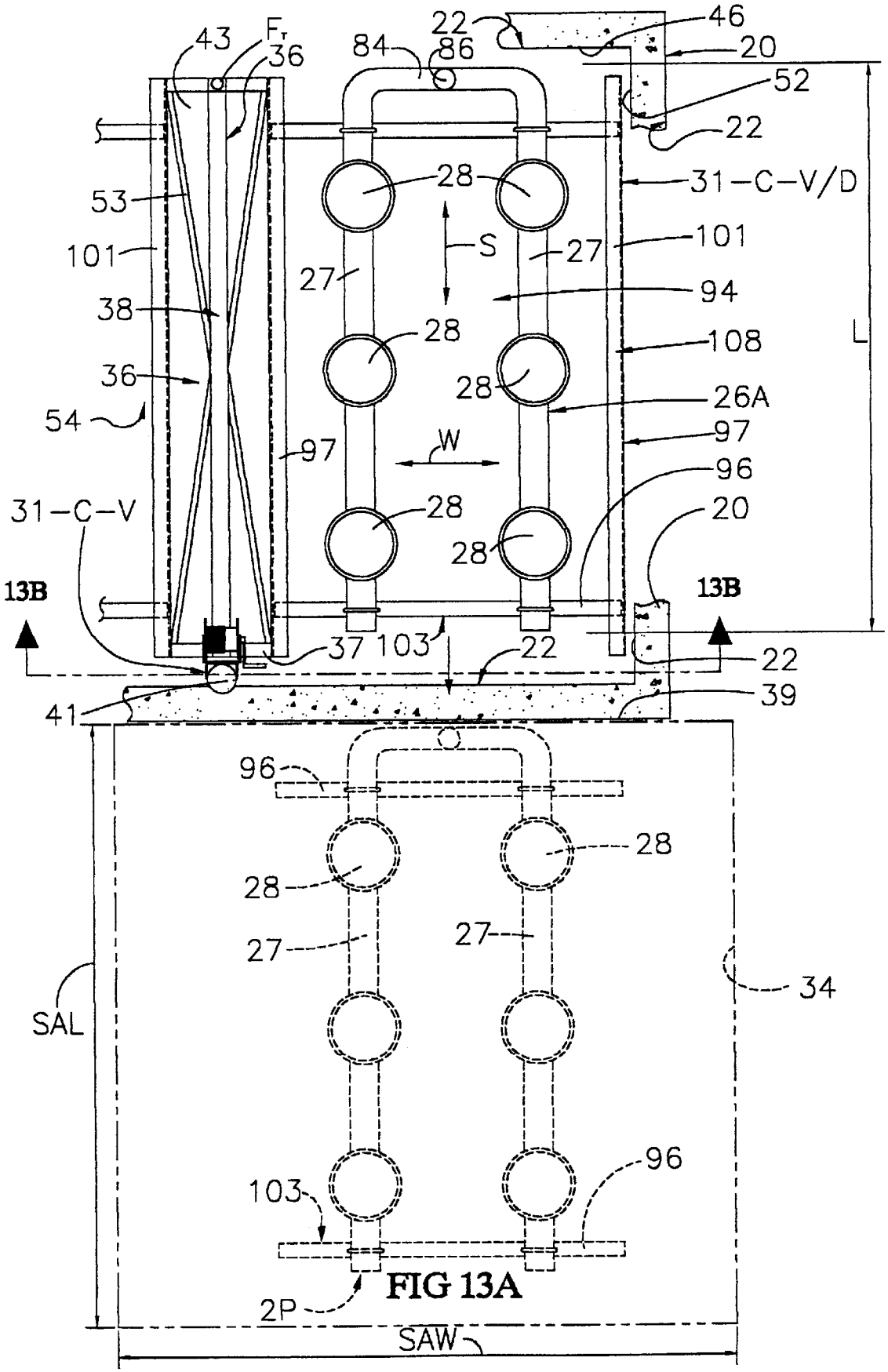
FIG. 13A is a plan view showing a compound movement embodiment of the present invention, wherein the first (vertical) component of the movement of an aeration unit is provided by one of the embodiments shown in FIGS. 1–12B, and a second (horizontal) component of the movement of the aeration unit is provided by a platform and guides to allow the aeration unit to move to a service area adjacent to but not over the basin.
Figure 20:
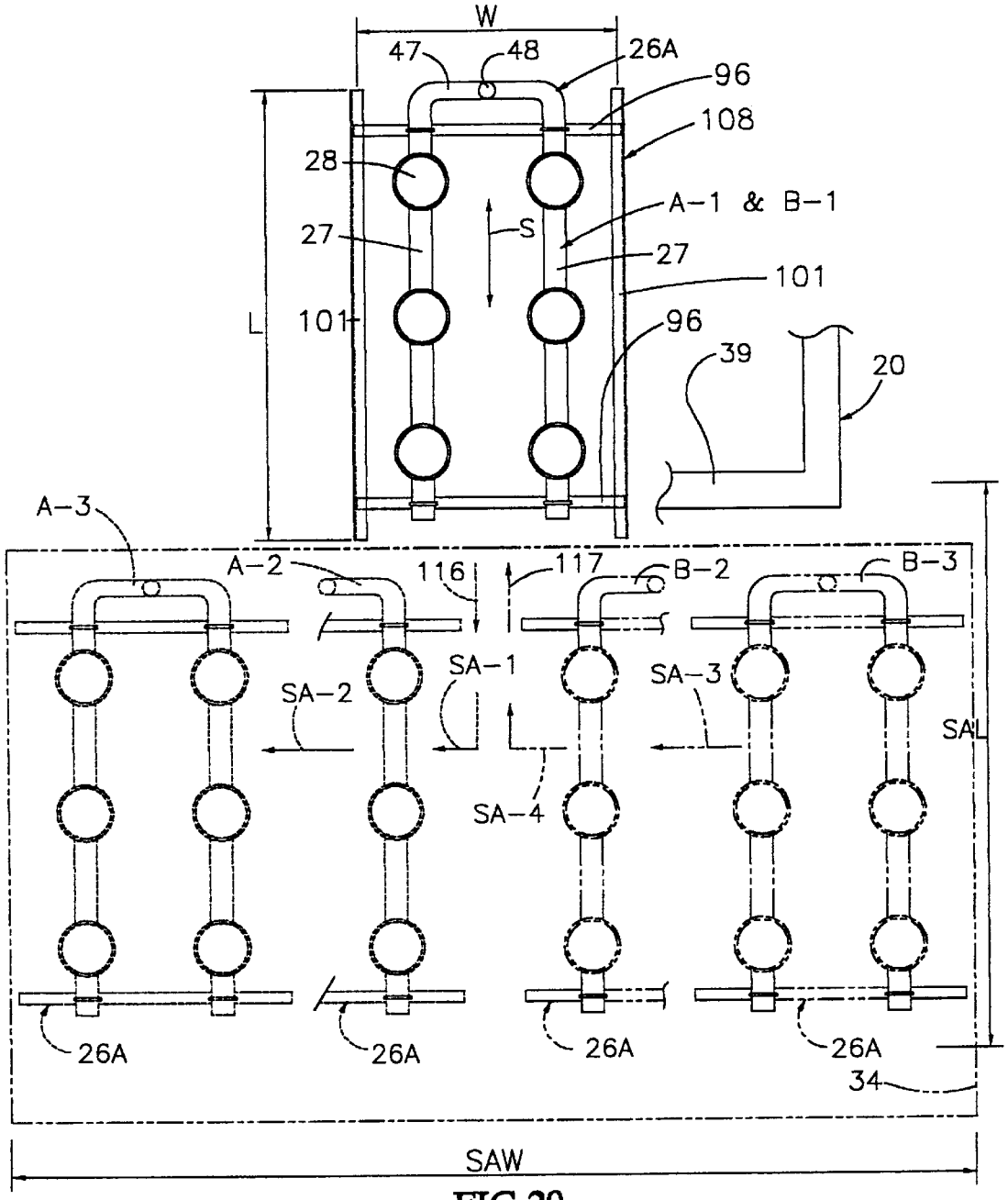
FIG. 20 is a schematic plan view diagram showing the steps of a method of the present invention for compound motion of the aeration unit, showing the second movement of the aeration unit after the aeration unit has been removed from the basin, where the second movement of the aeration unit continues over the service area to permit a substitute aeration unit to be mounted on the platform.

Referring to FIGS. 13A and 20, the basin 20 is provided with the near side 39 at which service personnel (not shown) operate the drive 41 (FIG. 13A). The service area 34 is provided as an area adjacent to the basin 20 on which the service personnel may work. In one aspect of such work, an aeration unit section 26A may simply be carried from the basin 20 over (or across) the service area 34 to another facility (not shown) for servicing. In another aspect of such work, the aeration unit section 26A may be serviced while over (or resting on) the service area 34. For either type of work, for example, the service area 34 may extend from the near side 39 away from the basin 20 for a distance SAL that may vary according to the length (in the direction "S", FIGS. 13A, 14A, 15A, and 20, for example) of the aeration units 26, or the sections 26A, 26B, etc., that are used in the basin 20. For example, if the aeration units 26 shown in the basin 20 in FIG. 13A have a section 26A having a length extending across the basin 20 (upwardly in FIG. 13A) for a distance L of thirty feet, and if the section 26A has a width W of fifteen feet (horizontally in FIG. 13A), then the dimension SAL of the service area 34 from the near side 39 of the basin 20 should be at least thirty feet (down in FIG. 13A) and the width SAW of the service area 34 should be at least fifteen feet. More likely, the length SAL would be forty feet and the width SAW would be twenty-five feet to provide room for service personnel to move around the section 26A, or the aeration unit 26, after the aeration unit 26 or section 26A has been moved over the service area 34.

FIG. 20 also shows a larger service area 34 suitable for having a first (A-1) aerator section 26A be replaced by a second (B-1) aeration section 26A. It may be understood that due to the need for more area in which to move the A-1 section 26A to position A-2 and to the left following arrows SA-1 and SA-2 to position A-3, and due to the need for more area in which to move the B-1 section 26A to the left from a position B-3 to a position B-2 following arrows SA-3 and SA-4, the dimensions of the service area 34 for such replacement exceed the dimensions of an individual one of the sections 26A.

Aeration Units 26

Figure 14A:
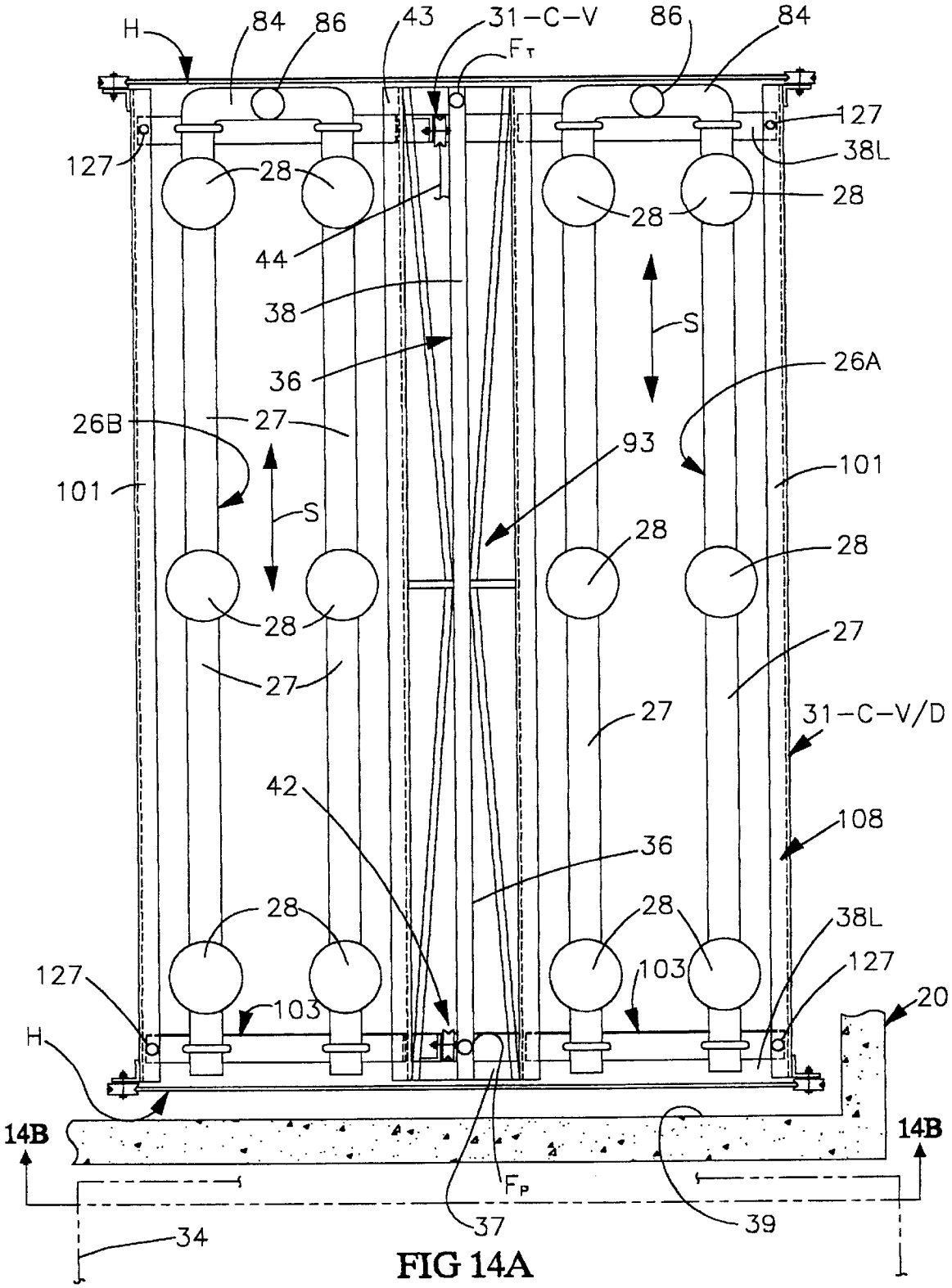
FIG. 14A is a plan view of a second of the compound movement embodiments, wherein a truss is the compression member of one of the embodiments shown in FIGS. 1–12B, and one pair of force transfer strands is provided at each end of the platform.

In the compound movement embodiment 31-C, aeration of the basin 20 is also performed by the aeration units 26, which include the pipes 27 to supply gas, such as air, to the diffusers 28. One section 26A of the aeration unit 26 is shown in FIG. 13A for aerating a portion of the basin 20 between the outer walls 22. In FIG. 14A, the aeration unit 26 is shown having many of sections 26A, 26B, etc. In FIGS. 13A, 14A, 15A, and 16A, pairs of adjacent aeration unit sections 26A share one module 36. However, each section 26A, 26B, etc. may be moved by two modules 36, such as shown in FIG. 9C. The number of sections 26A, 26B, etc., and the number of modules 36 per section 26A, 26B, etc. may be selected according to the characteristics of the aeration desired for the basin 20.

Figure 15A:
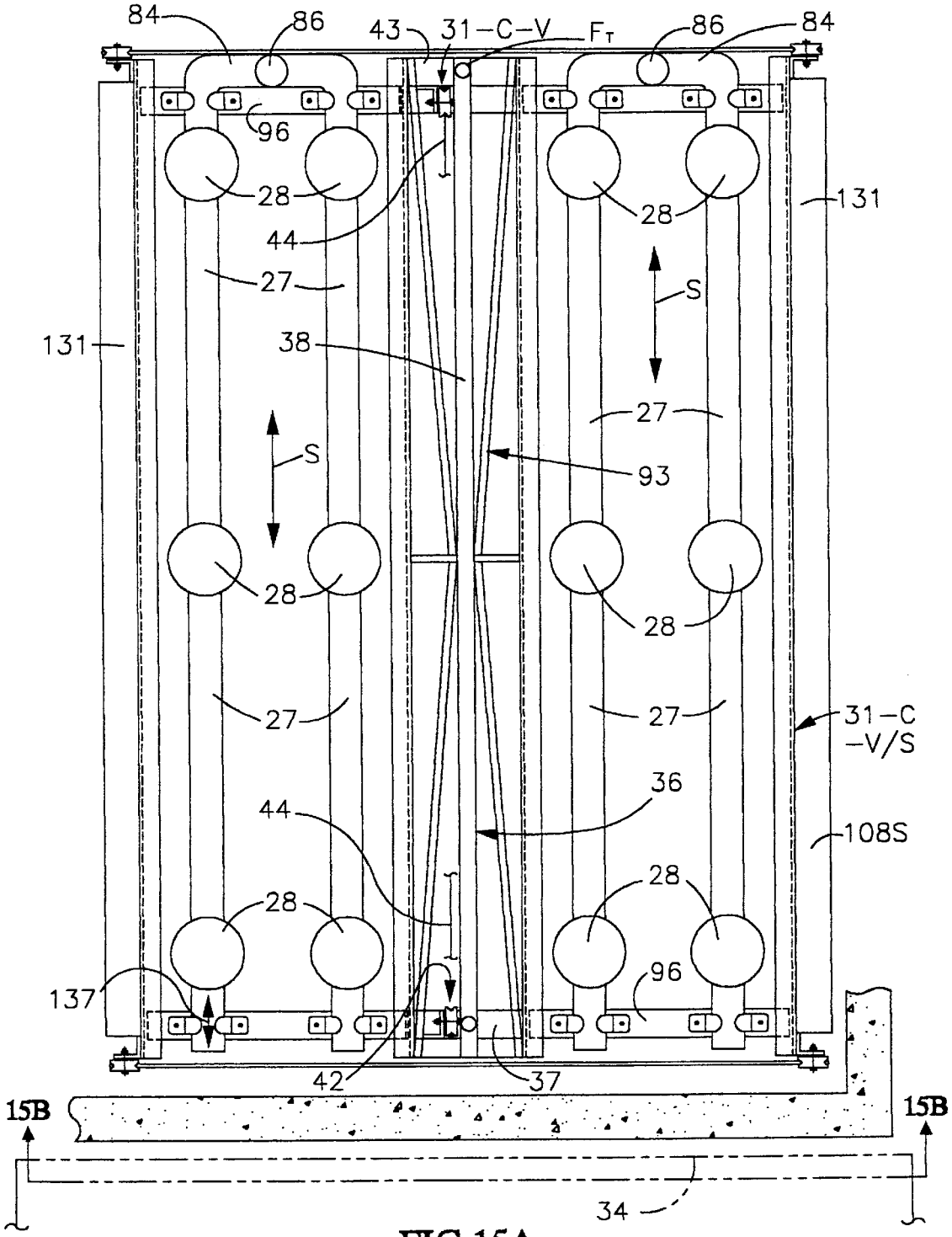
FIG. 15A is a plan view similar to FIGS. 13A and 14A of the compound movement embodiment of the present invention, wherein a second platform is shown including arcuate guides in the form of saddles directly engaging the pipes of the aeration unit for guiding the pipes off the platform to a position over the service area.
Figure 16A:
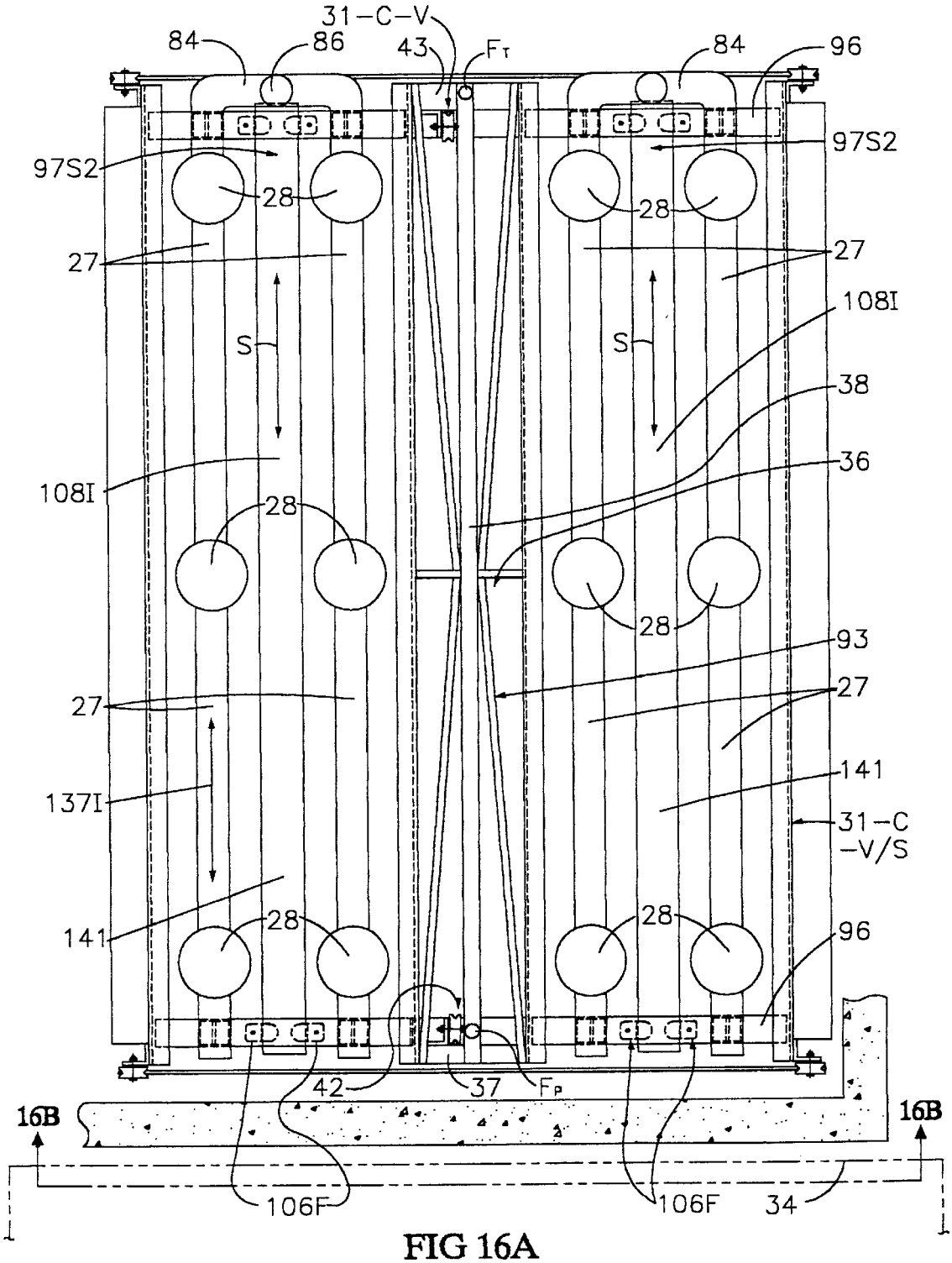
FIG. 16A is a plan view similar to FIGS. 13A, 14A, and 15A of the compound movement embodiment of the present invention, wherein a second platform is shown supported by a truss and the platform is provided with structural pipe guides, and the aeration unit has saddles directly engaging the pipe guides for guiding the aeration unit off the platform to a position over the service area.
Figure 17A:
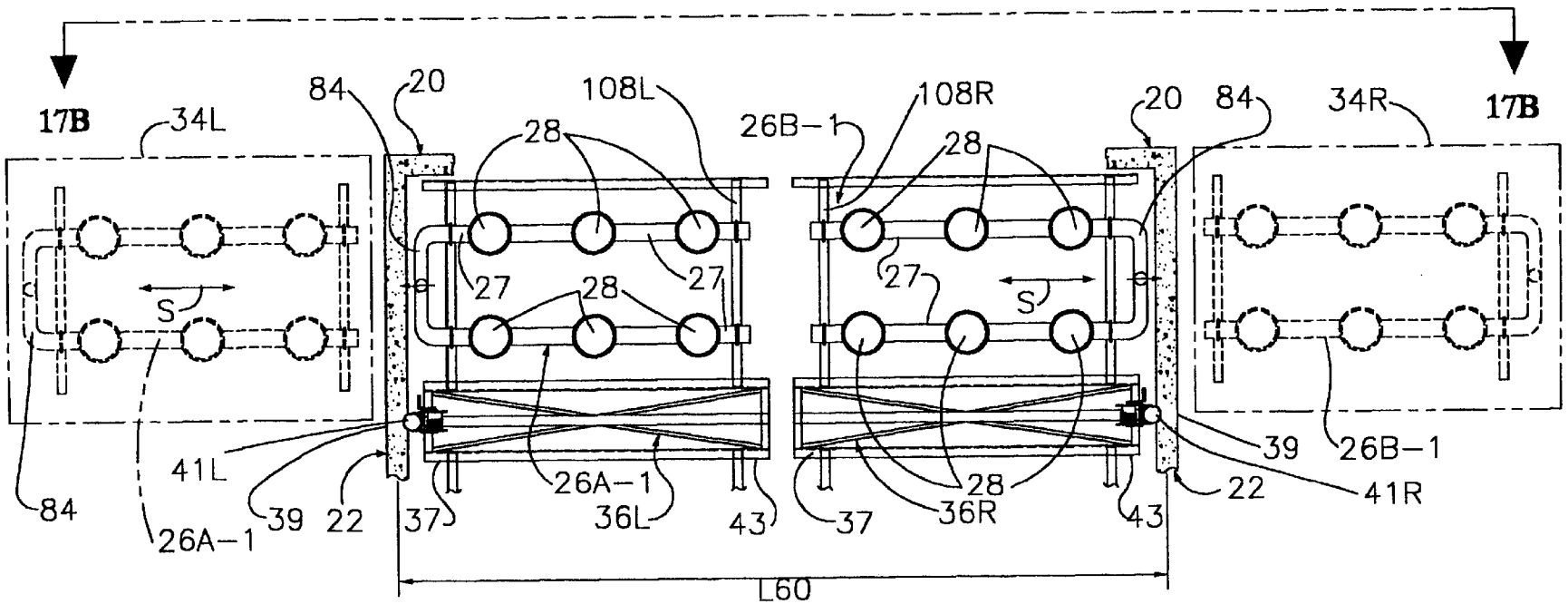
FIG. 17A is a plan view of the compound movement embodiment of the present invention, wherein the aeration unit is divided into two thirty foot sections, and each such section is separately movable off the platform to a position over a separate service area next to one of the opposite ends of the basin.
Figure 17B:
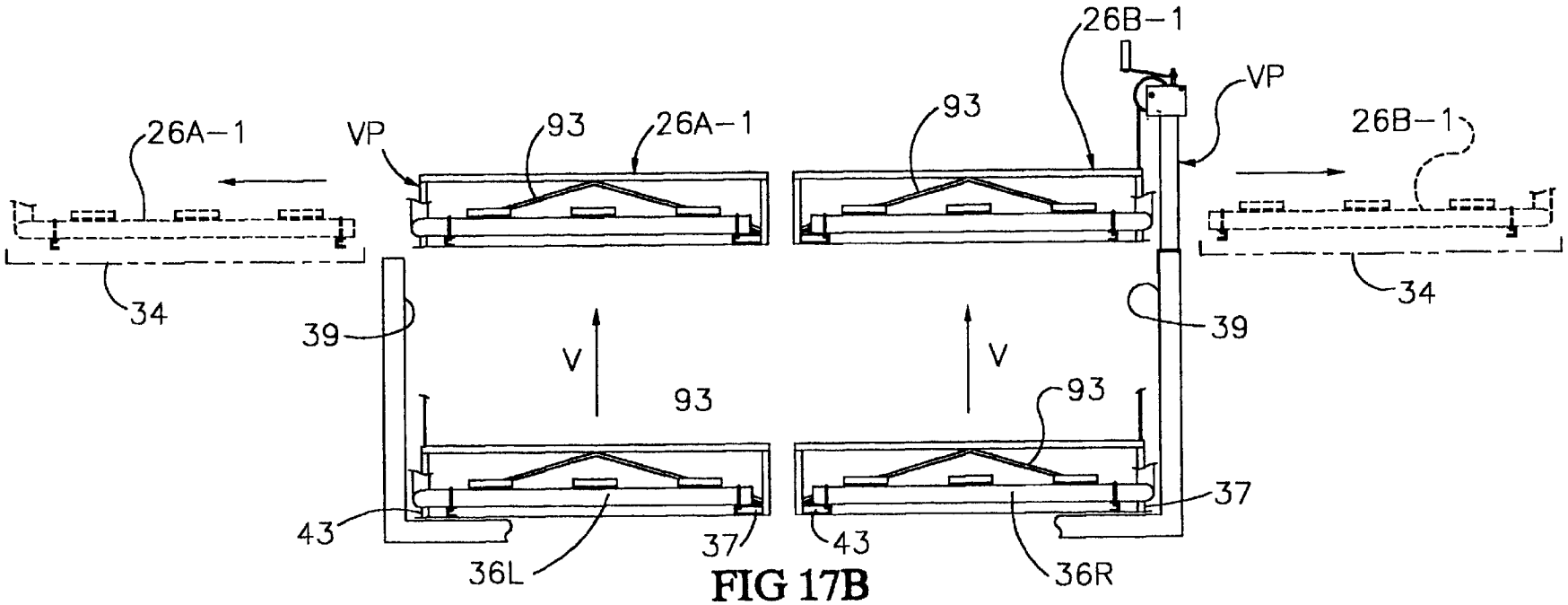
FIG. 17B is an elevational view taken along line 17B—17B in FIG. 17A showing separate retrieval devices for each section of the aeration unit.

The pipes 27 of each aeration unit section 26A, etc. are shown in FIGS. 13A, 14A, 15A, 16A, and 17A extending in the direction of arrows S which designate the direction of the second movement of the compound movement. The arrows S extend in the direction of the length L of the aeration unit 26 (FIG. 13A) from close to the near side 39 to close to a far side 83 of 46 of the basin 20. FIG. 17A shows a basin 20 having a sixty foot length L60. Such basin 20 has two sections 26A and 26B on one side (upper in FIG. 17A) of the module 36, and (not shown) may have two sections 26A and 26B on the other side of the module 36. Such basin 20 has two sections 26A and 26B across such sixty foot length L.

Figure 13B:
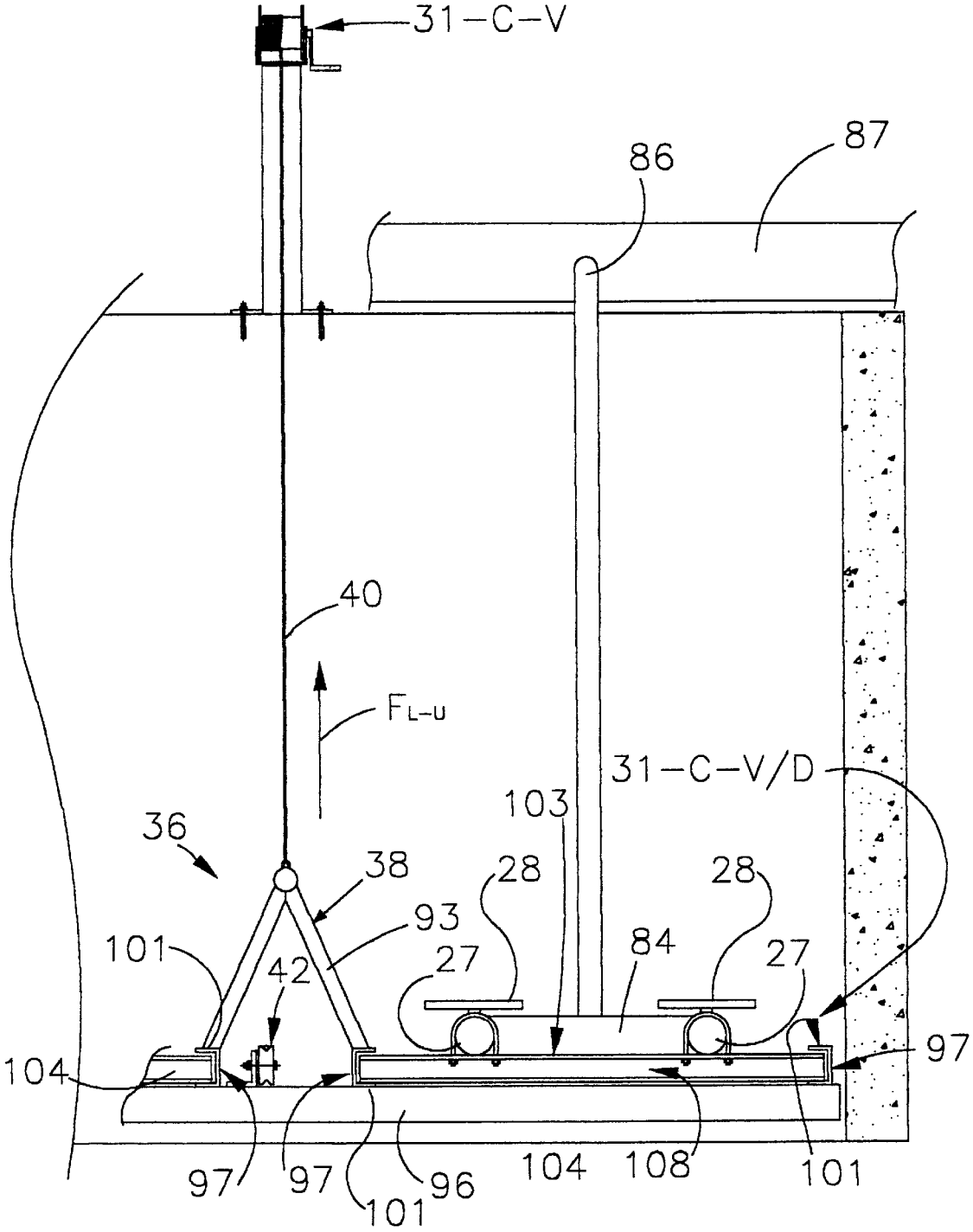
FIG. 13B is an end elevational view of the compound movement embodiment taken along line 13B—13B in FIG. 13A.

A header 84 is connected to the pipes 27 of the module 36 to supply the gas which the pipes 27 supply to the diffusers 28. FIGS. 13A, 14A, 15A, and 16A show two pipes 27 per section 26A. The number of such pipes 27 may be varied according to the aeration requirements. A drop leg 86 may be a flexible hose to supply the gas to the header 84 from a main supply manifold 87 (FIG. 13B). Alternatively, the drop leg 86 may be rigid (e.g., made from stainless steel) and a flexible conduit (not shown) may be connected to the rigid drop leg 86. Generally, the drop leg 86 is disconnected from the header 84 before the start of the first movement.

Retrieval Apparatus 31-C

One retrieval apparatus 31-C-V of the present invention is shown in FIGS. 13A and 13B used with one of the sections 26A of the aeration units 26 which aerates a first area 91 of the basin 20 between the walls 22 that define the near side 39 and the far side 83, and between a side wall 92 of the basin 20 and the compression member 38 of the retrieval apparatus 31-C-V. The compression member 38 is shown in the form of a truss 93 which extends in the direction of the arrow S. Another section 26A is provided (not shown) for aerating an adjacent area 94 of the basin 20. Depending on the dimensions of the basin 20, one retrieval apparatus 31 may carry one or more aeration sections 26A, 26*b*, etc. For example, in FIG. 17A, one section 26A, etc. is in each of four quadrants of the basin 20. Generally, each section 26A of the aeration unit 26, and each section 31A of the respective retrieval apparatus 31, is separate from the other respective sections 26B of the aeration unit 26, and from the respective other sections 31B of the retrieval apparatus 31. Thus, by the compound movement of the present invention, the sections 26A and 26B of the aeration unit 26 (which are mounted on one truss 93) may be retrieved and serviced (or repaired) while all of the other sections 26C, etc. of the aeration unit 26 (which are mounted on a different truss 93 of a different module 36) remain functional.

In the compound movement embodiment of the present invention, the retrieval apparatus 31-C-V of the present invention may be used to perform the first of the compound movements. When the retrieval apparatus 31-C-V carries two aeration sections 26A and 26B, that first movement removes the sections 26A and 26B from the basin 20, as by lifting the sections 26A and 26B upwardly out of the liquid 21. As described above, the same section 31-C-V of the retrieval apparatus 31 may be used to forcefully move the sections 26A and 26B back into the basin 20 against the buoyant forces for aeration operation.

Compound Movement Embodiment 31-C-V

First Movement

Figure 14B:
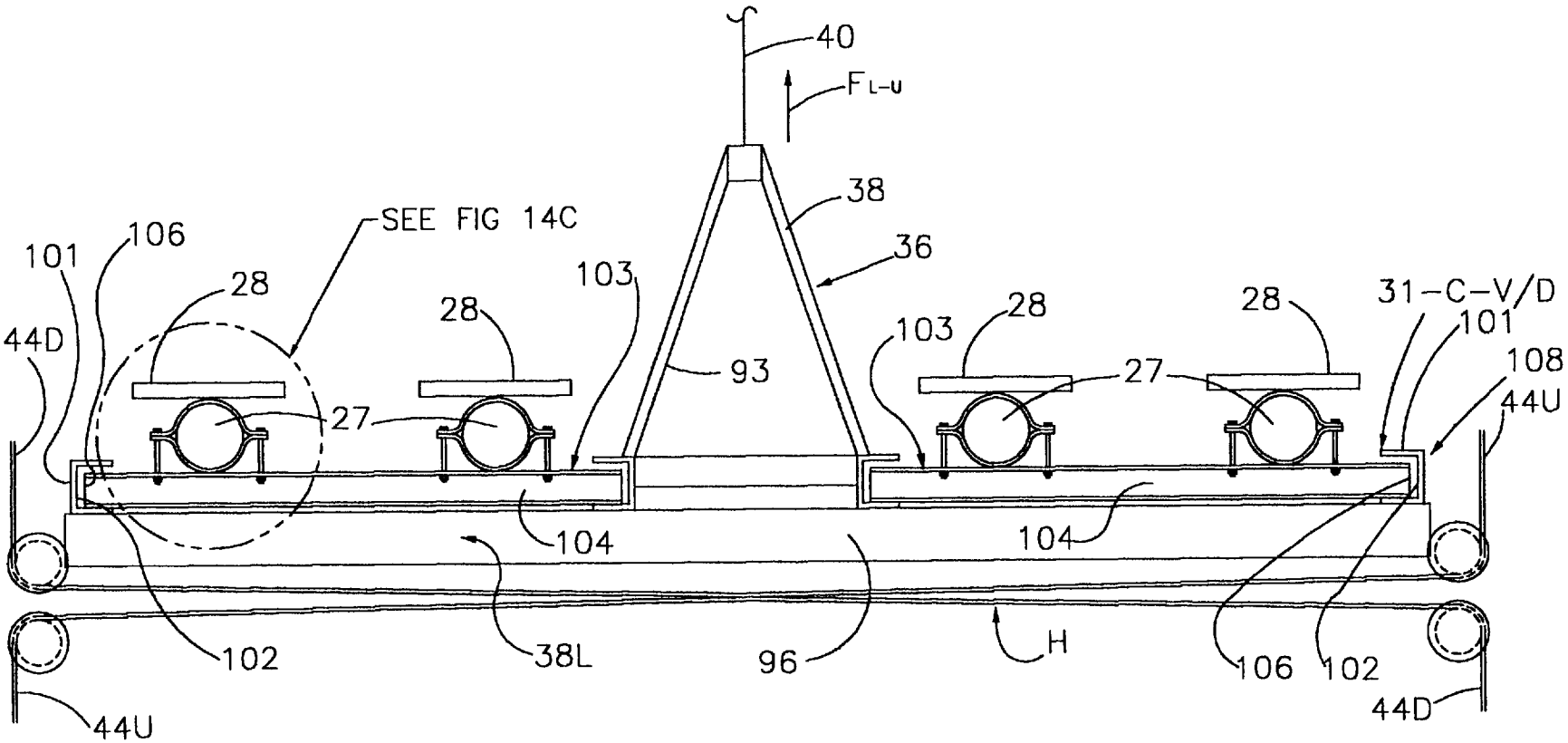
FIG. 14B is a cross sectional view taken along line 14B—14B in FIG. 14A showing the platform and the guide in the form of a drawer for supporting the aeration unit, and a drawer guide that allows the drawer to move the aeration unit over the service area.
Figure 21A:
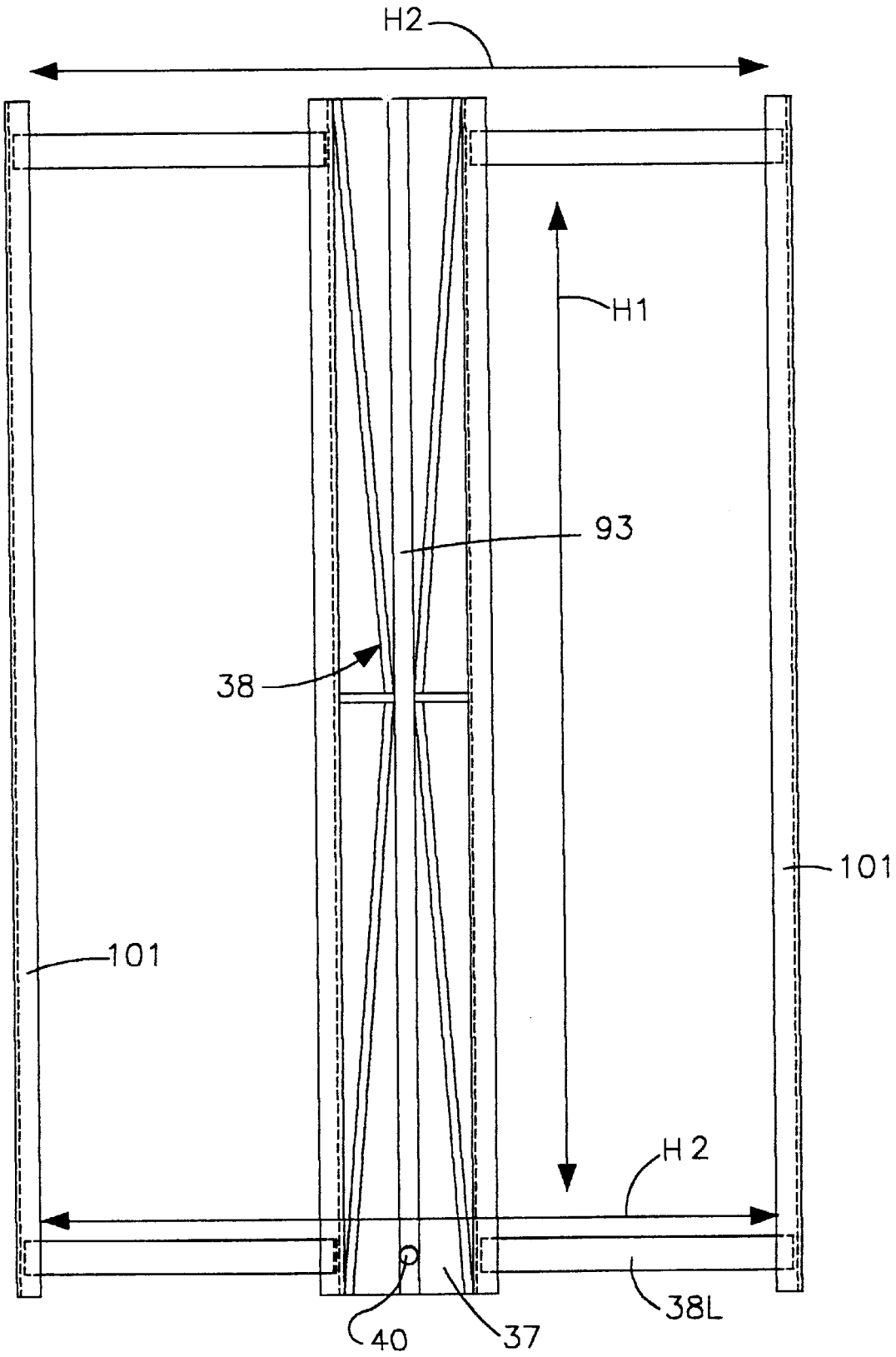
FIGS. 21A–21C are schematic plan views showing the vector force transfer embodiment.
Figure 21B:
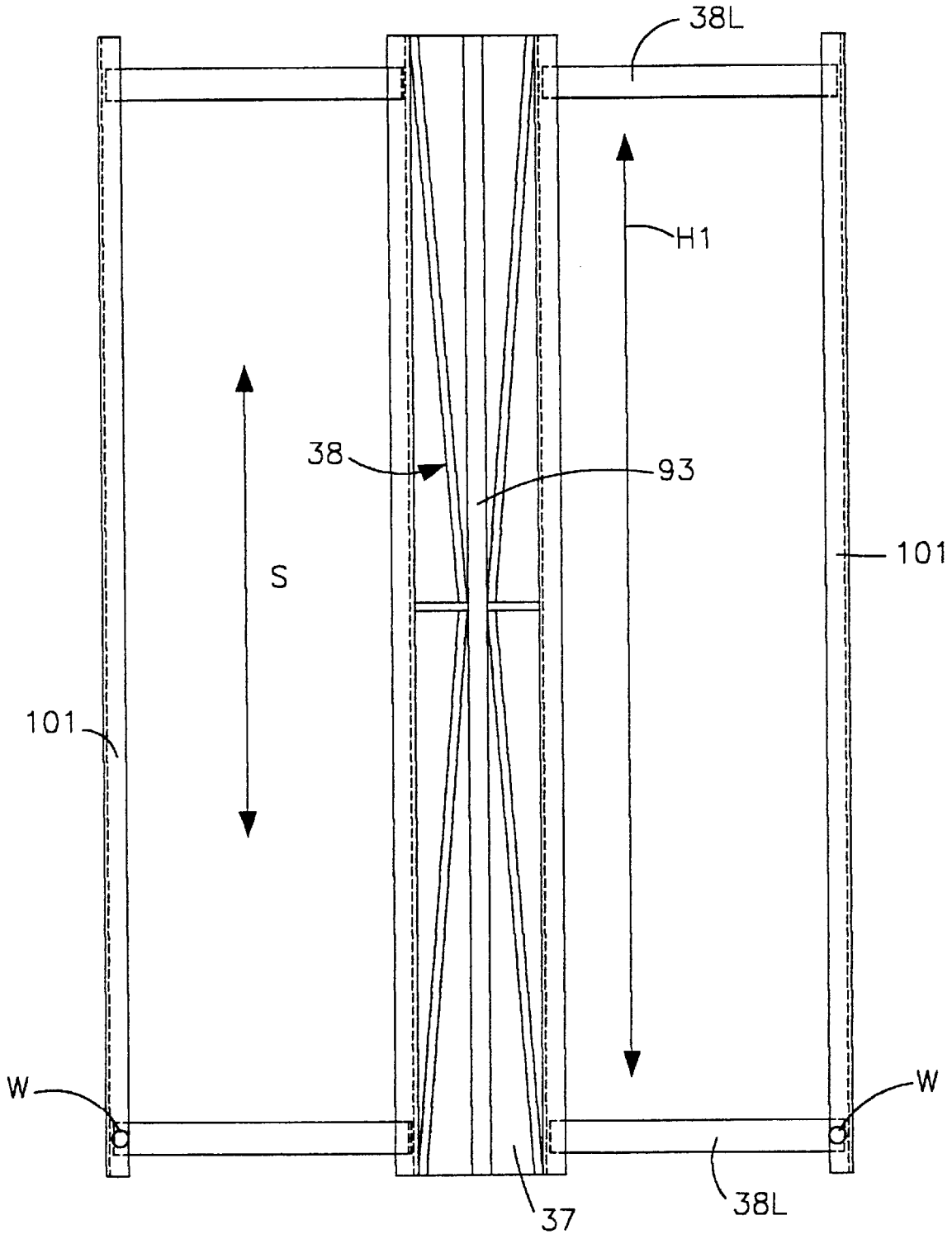

The basic module 36 of the first embodiment 31-1 of the retrieval apparatus 31 (shown in FIGS. 1, 3, 4 and 5) corresponds to the module 36 of the embodiment 31-C-V which provides the first movement of the compound movement embodiment 31-C-V of the present invention. Referring in detail to FIGS. 14A, 14B, and 21A, the compression member 38 of FIGS. 1, 3 and 4 corresponds to the truss 93. The force applicator 40 is provided attached to the proximate end 37 of the truss 93. The truss 93 is also provided with the vector force transfer device 42 including strands 44 (FIG. 14A). In detail, two oppositely configured force transfer strands 44U and 44D (see FIG. 14B) which cooperate in the manner described above with respect to FIG. 5 to provide the first movement (up and down) while keeping the member 38 (the truss 93) level. The vector force transfer strands 44U and 44D form an "H-shape" as seen in FIGS. 14B and 21A (see "H1"). This same configuration is provided for the retrieval apparatus 31-C-V shown in FIGS. 13A, 13B, 15A, 16A, and 16B, and is shown more schematically in FIG. 21A.

The truss 93 may be of the type designed to span the necessary distance across the basin 20, and may be as shown in co-inventor C. L. Meurer's U.S. Pat. No. 5,217,614, for example, which is incorporated herein by this reference. The truss 93 may also be designed to resist torsional forces that tend to rotate the truss 93 clockwise or counterclockwise as viewed in FIGS. 13B and 14B. In this case, as shown schematically in FIG. 21B, only the one vector force transfer device 42 is used with the truss 93 (see "H1") in FIG. 21B).

However, to provide increased resistance to such torsional forces, FIGS. 14A, 14B and 21A show two additional and lateral compression members 38L secured to the truss 93. Each such member 38L is provided with two force transfer strands 44U and 44D. The strands 44U and 44D form the "H-shape" as seen in FIGS. 14B and 21A (see "H2"). These strands 44U and 44D perform in the same manner as the strands 44U and 44D shown in FIG. 5 to keep each of the lateral compression members 38L level as the truss 93 is urged to move by the force applicator 40.

Compound Movement Embodiment 31-C-V/D

Second Movement

As described above, the service area 34 adjacent to the near side 39 of the basin 20 is dimensioned to provide room for service personnel to move around a section of the aeration unit 26 (e.g., the section 26A) when that section 26A has been moved over the service area 34. Such movement of the section 26A to the position over the service area 34 represents the second of the compound movements. The elements which provide such second movement are first described with reference to FIGS. 13A–13C. There, the truss 93 forms the compression members 38 and supports lateral beams 96. The lateral beams 96 extend in the direction of a width W of the basin 20 and are secured to the truss 93. The lateral beams 96 are provided with guides 97 which may directly or indirectly engage the pipes 27 to guide the second of the compound movements of the pipes 27.

Figure 13C:
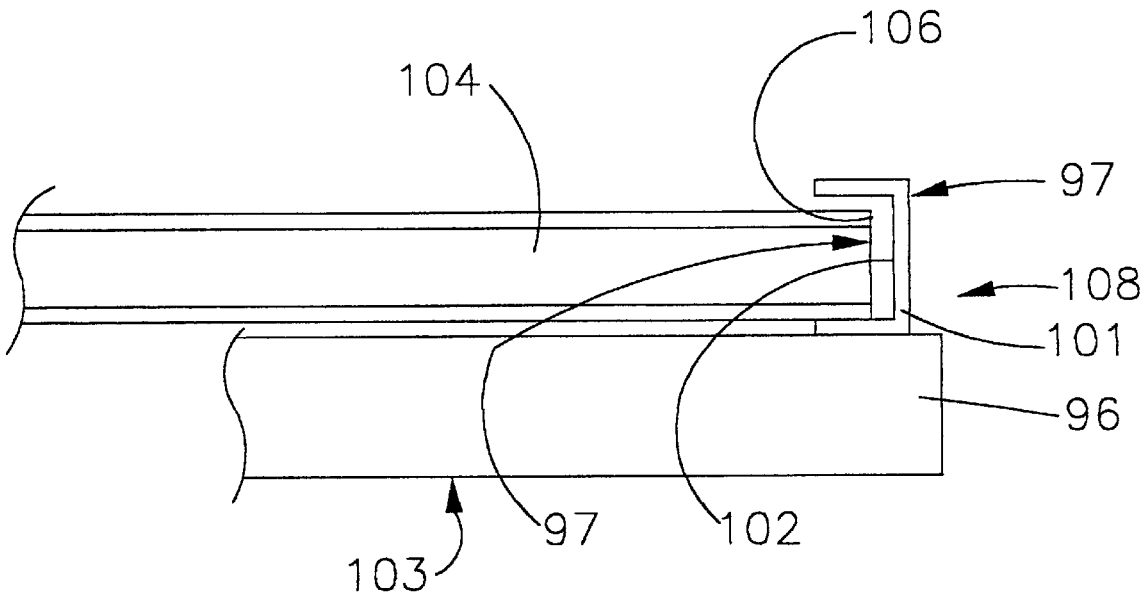
FIG. 13C is an enlarged view of the guides shown in FIG. 13B.

In FIGS. 13A–13C the guides 97 are shown in the form of opposed channels 101. Each of the opposed channels 101 is secured to and extends in the direction S between the lateral beams 96. Each channel 101 defines a guide slot (or drawer guide) 102 that extends parallel to the direction S of the length L of the basin 20, which is the direction of the second movement of the compound movement.

A drawer 103 is shown in FIGS. 13A. 13B, 13C, 14A, and 14B connected to the two pipes 27 of the section 26A of the aeration unit 26. The drawer 103 may be in the form of a series of bars or rods 104 that extend in the direction of the width W of the basin 20. Each of the bars 104 has opposite ends (or followers) 106 that are received in, and ride along, the slots 102 of the channels 101. The channels 101 are mounted on the lateral beams 96 in spaced relation in the direction W so that the guide slots 102 receive and retain the followers 108, yet engage the followers 108 loosely enough to allow the followers 108 to move in the second compound direction S.

The truss 93, the lateral beams 96, and the guides 97 (via the channels 101 and the guide slots 102) are referred to as a platform 108 in that these elements carry (or mount or provide a base for) an aeration unit section 26A (or many such sections 26A, 26B, etc.) and cause the first movement of such sections 26A, 26B, etc., yet permit the second movement of such sections 26A, 26B, etc. The pipes 27 are bolted (as by using U-bolts 109) to the bars 104. In this manner, each of the aeration unit sections 26A, etc. shown in FIGS. 13A–13C is composed of the pipes 27, the headers 84, the drop legs 86, and the drawers 103 (including the bars 104 and the followers 106), which aeration unit 26A is movable on the platform 108.

Figure 14C:
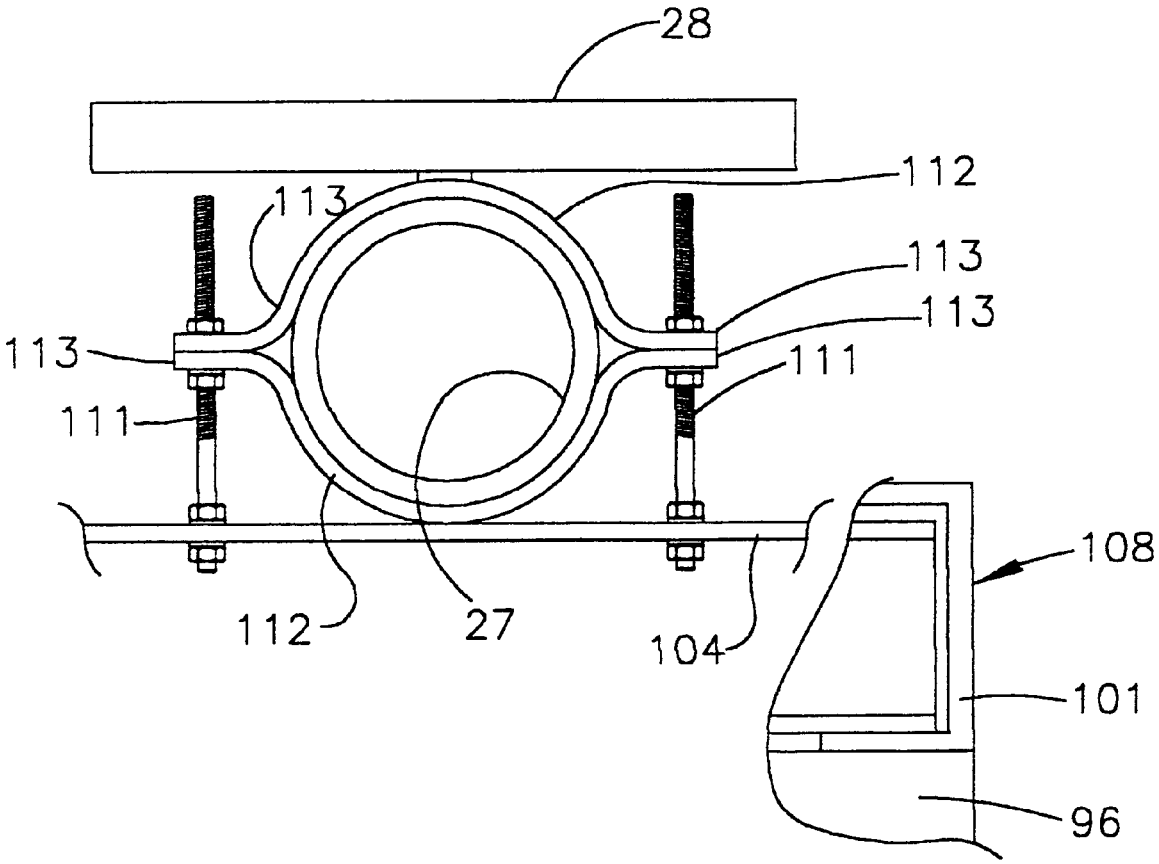
FIG. 14C is an enlargement of part of FIG. 14B showing a device for leveling the pipes relative to the platform.

In FIGS. 14A–14C, the structures of the aeration unit sections 26A and of the platforms 108 are very similar, with only the following exceptions:

(1) the lateral beams 96 are also the compression members 38L to cooperate with the two "H" vector force transfer devices 42, and (2) the drawers 103 carry levellers 111, rather than the U-bolts 109, for securing the pipes 27 to the bars 104.

The levellers 111 are shown enlarged in FIG. 14C and include opposed C-shaped clamps 112. The clamps 112 have tabs 113 drawn together by bolt-nut assemblies 114 to hold a pipe 27 at a selected position or spacing "LD" from the bar 104. According to how far the tabs 113 are held by the assembly 114 from the bar 104, the position of the pipes 27 may be adjusted relative to the bars 104 to level the pipes 27 when the pipes 27 are returned to the basin 20.

Referring to FIGS. 13A–13C, and 14A–14C, when the first compound movement has been completed, such that the platform 108 carrying the aeration unit sections 26A, 26B, etc. have been moved out of the basin 20, one such section 26A, 26B is selected. The service personnel standing on the service area 34 adjacent to the near side 39 of the basin 20 may pull on the selected aeration unit section 26A by pulling on the drawer 103 of such section 26A in the direction S to move the drawer 103. As the drawer 103 moves in the direction S, the followers 106 are guided by the slots 102. In this manner, the pipes 27 of the selected section 26A move in the second compound direction S with the drawer 103. The drawer 103, with the bars 104, the followers 98 and the pipes 27, may thus move completely off the platform 106 and become positioned over the service area 34. At this time, the service personnel may move the aeration unit 26A across the service area 34, or may perform any necessary service or repair, such as replacing one or more of the diffusers 28, or repairing one of the pipes 27, for example. Also, such service personnel may also adjust one of the many levellers 111 (FIG. 14C) provided on the platform 108 as described above. The platform 108 may remain over the basin 20, awaiting completion of the servicing operation.

It may be understood that in the embodiment 31-C-V/D shown in FIGS. 13A–13C and 14A–14C, the module 36 (e.g., the truss 93 with the force applicator 40 and vector the force transfer device 42) perform the function of lifting the platform 108 and the aeration unit section 26A out of the basin 20 to a predetermined vertical position (see "VP" in FIG. 17B) over the basin 20. Such lifting provides the first movement (up in FIG. 13B) to the vertical position VP (FIG. 17B) over the basin 20. Also, the platform 108 (via the truss 93, the lateral beams 96, and the slots 102) provides the function of supporting an individual aeration unit section, e.g., 26A or 26B. Such support is for the first of the compound movements, e.g., vertical. Also, the drawer 103, with the followers 106, serve the function of mounting the sections (e.g., 26A) of the aeration unit 26 for horizontal movement relative to the retrieval apparatus 31-C-V independently of the first compound movement. That is, the section 26A, for example, may move in the second direction S apart from the motion of, or relative to, the platform 108. Further, the guides 97, via the channels 101 and the guide slots 102, serve the function of guiding the second of the compound movement, which is of the drawer 103 and of the section (e.g., 26A) of the aeration unit 26 mounted on the drawer 103, relative to the retrieval apparatus 31-C-V to permit a far side 83 of the aeration unit sections (e.g. 26A) to move adjacent to the first end 37 of the truss 93, which is also adjacent to the near side 39 of the basin 20. Such guiding to the far side 83 ends when the followers 106 exit from the slots 102 adjacent to the proximate end 37 of the truss 93 to facilitate servicing of the aeration unit section (e.g., 26A). The guiding function is thus performed with the channels 101 extending in the direction S perpendicular to the wall 22 at the service side 39 of the basin 20.

Further, the channels 101 with the guide slots 102, serve the function of permitting the aeration unit sections (e.g., 26A) to move in such second of the compound movements. The function of permitting the aeration unit section 26A to move in such second of the compound movements is also facilitated by the drawer 103, with the followers 106 which are received in and are retained by the guide slots 102 to guide the drawer 103 and allow the followers 106 to move in the second compound direction S, which is the direction of an arrow 116 in FIG. 20. Still referring to FIG. 20, the pipes 27 thus move off the platform 108 and over the service area 34. Similarly, the guide slots 102 serve the function of slidably mounting the pipes 27 for return movement in a direction of a return arrow 117, which is the second of the compound movements in the S direction opposite to that of the arrow 116.

Additionally, the guide slots 102 in the channels 61 function to hold the drawer 103, and the aeration unit section (e.g., 26A) connected to the drawer 103, down against the buoyant forces when the aeration unit section (e.g., 26A) and the drawer 103 are in the basin 20 under the liquid 21.

Compound Movement Embodiments 31-C-C and 31-C-W

Figure 18:
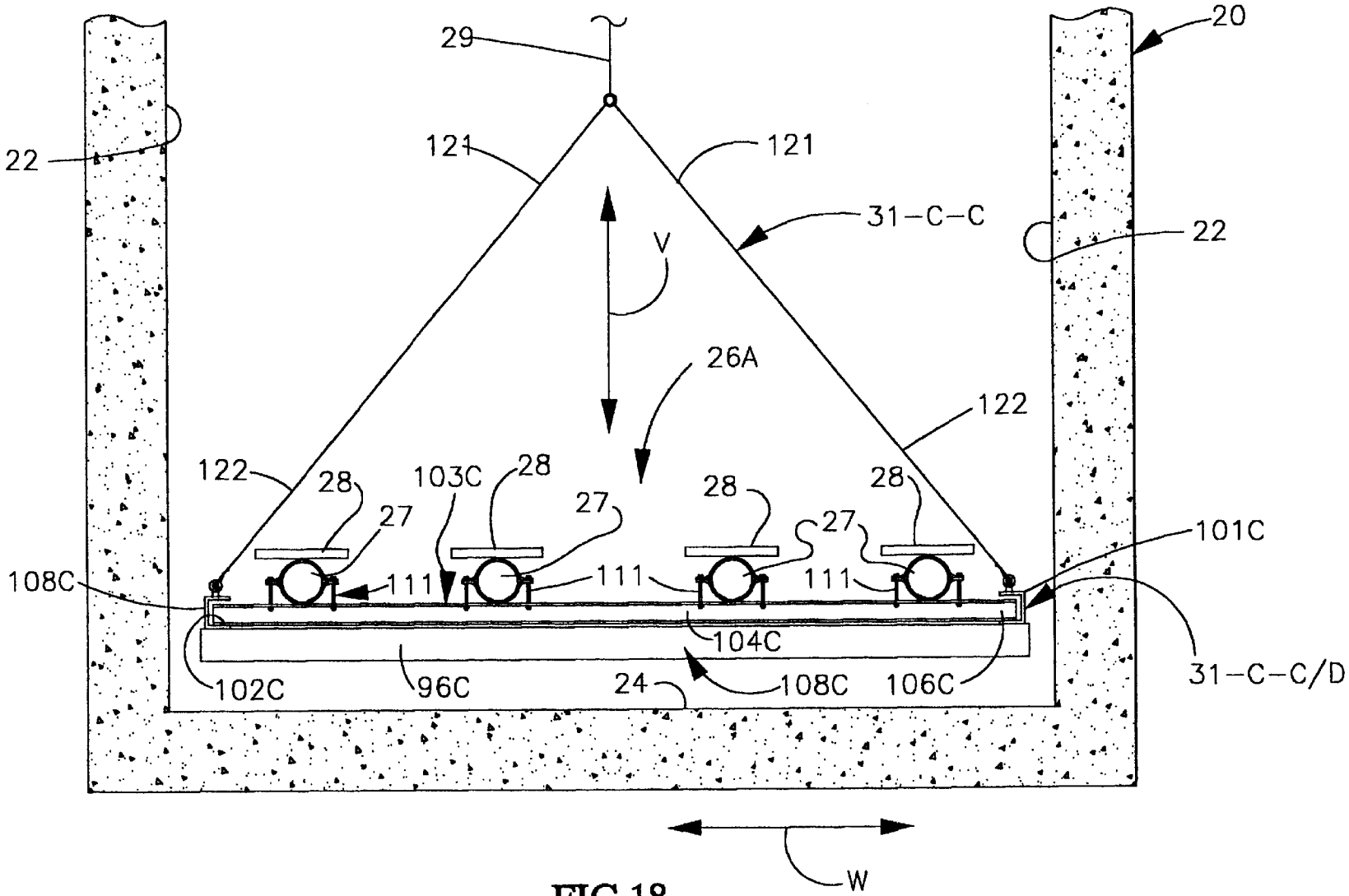
FIG. 18 is an elevational view showing a cable and bridle arrangement of an aeration unit retrieval device of the compound movement embodiment of the present invention, wherein the arrangement applies vertical forces to a platform that carries the aeration unit, and guides of the platform allow the aeration unit to move in the second component of the compound movement.
Figure 21C:
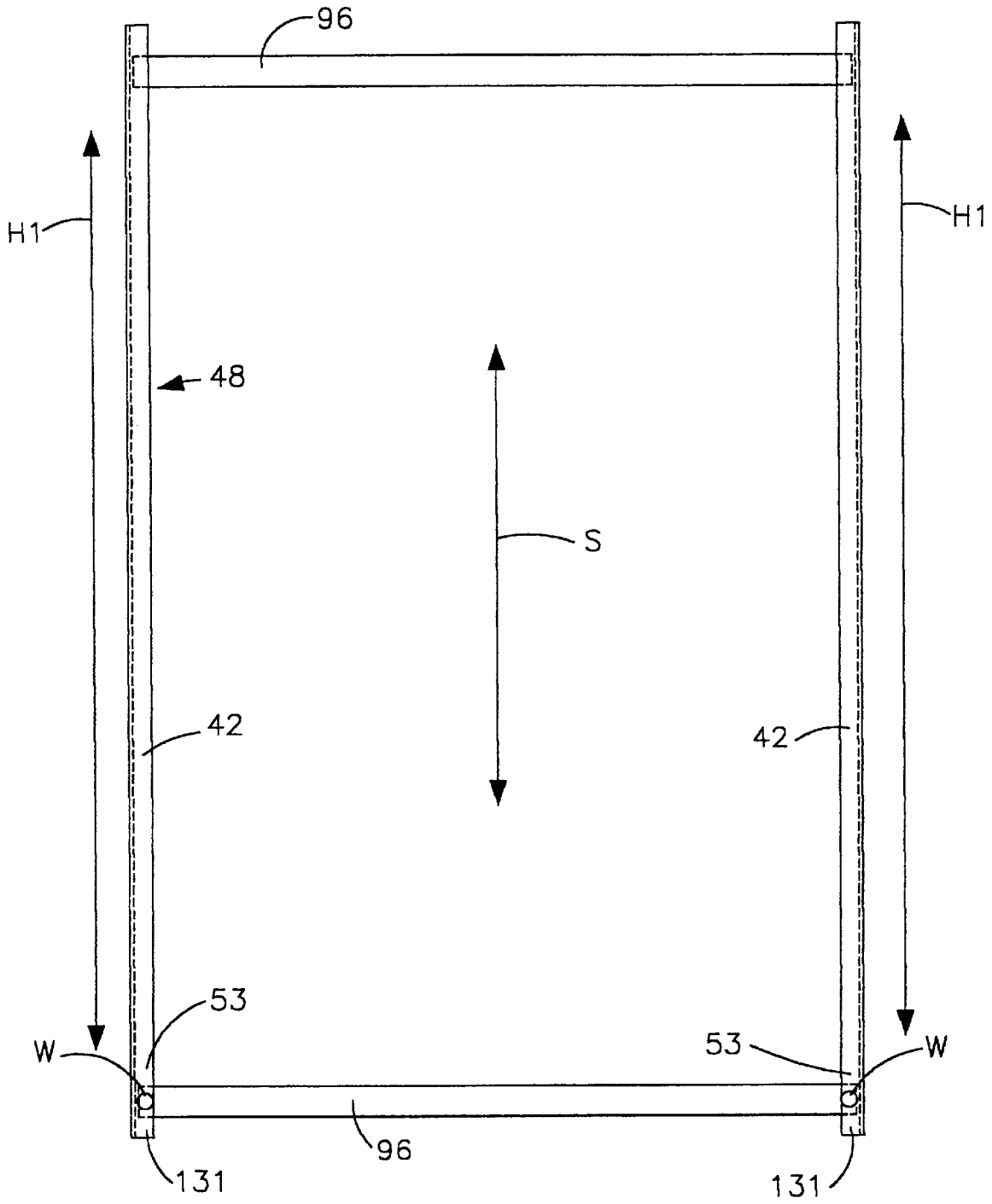
Figure 21D:
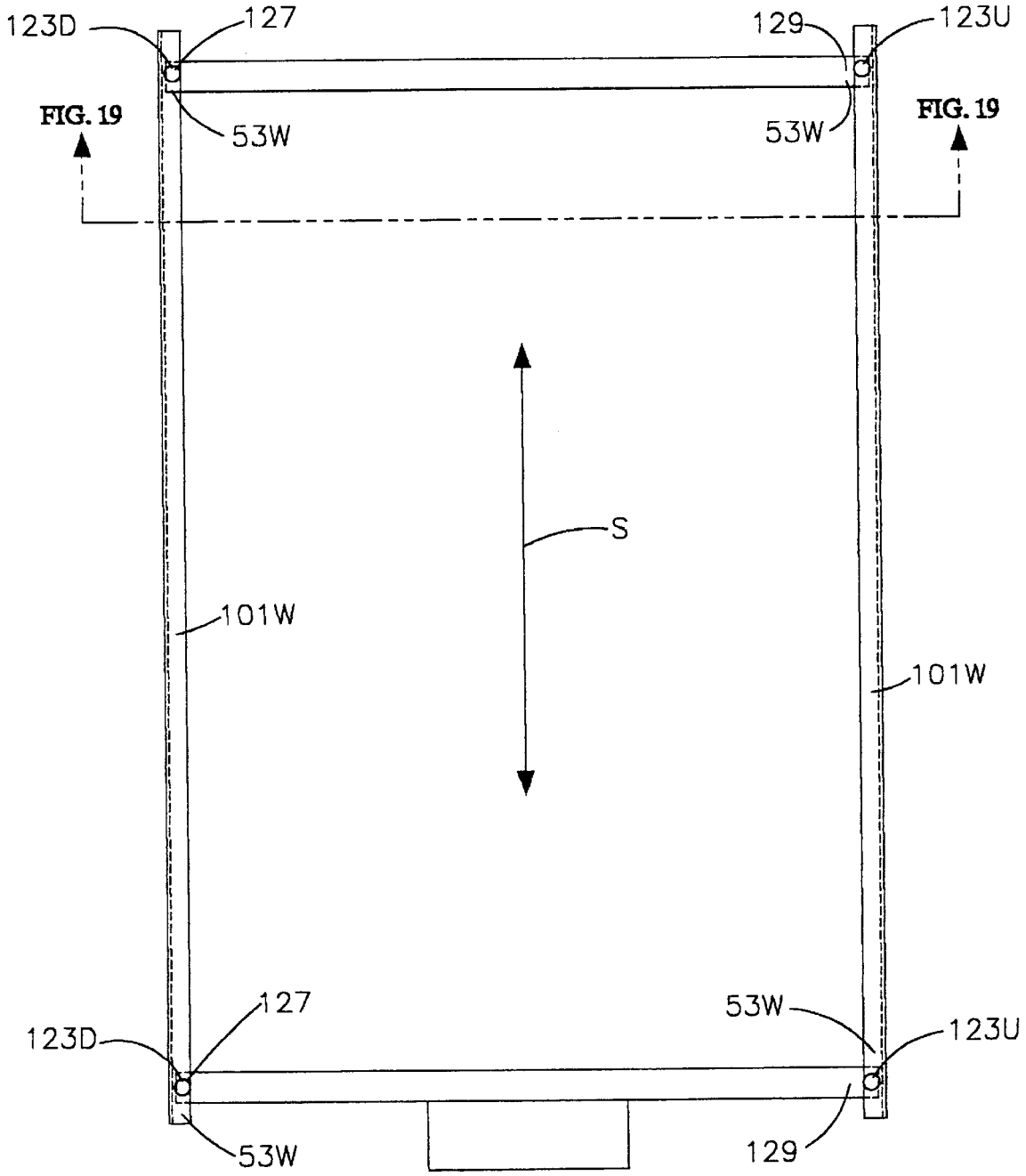
FIGS. 21D and 21E show respective winch and cable embodiments; all for performing the first component of the compound movement.
Figure 21E:
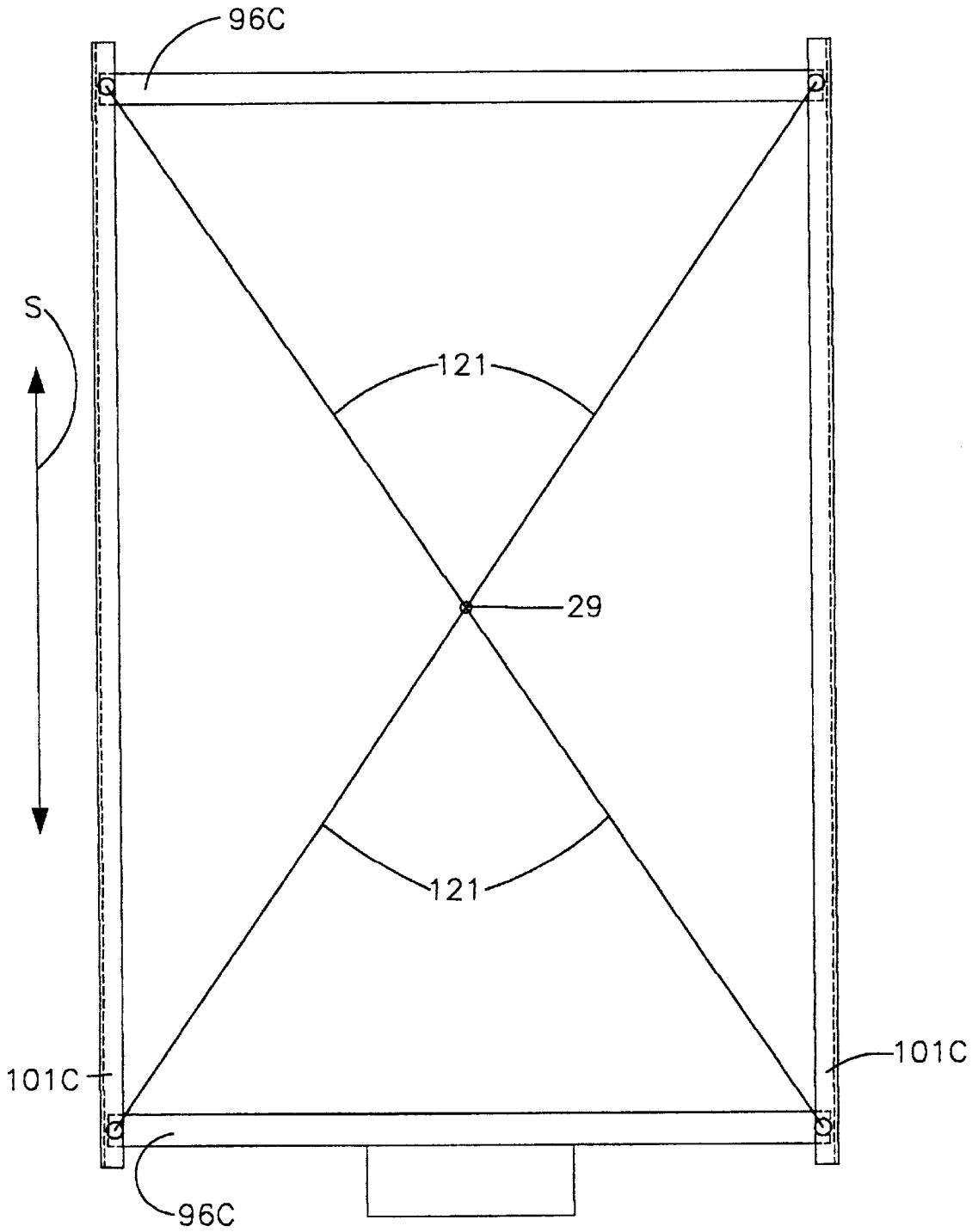

Referring to FIGS. 18 and 21E, a section 26A of the aeration units 26 is shown mounted for compound movement, including for the first movement in the direction V. In FIG. 18 the first movement (upward) is provided by a main cable 29 attached to a bridle 121. Opposite ends 122 of the bridle 121 are attached to opposite ends of the elongated channel 101C that is connected to a lateral beam 96C.

Figure 19:
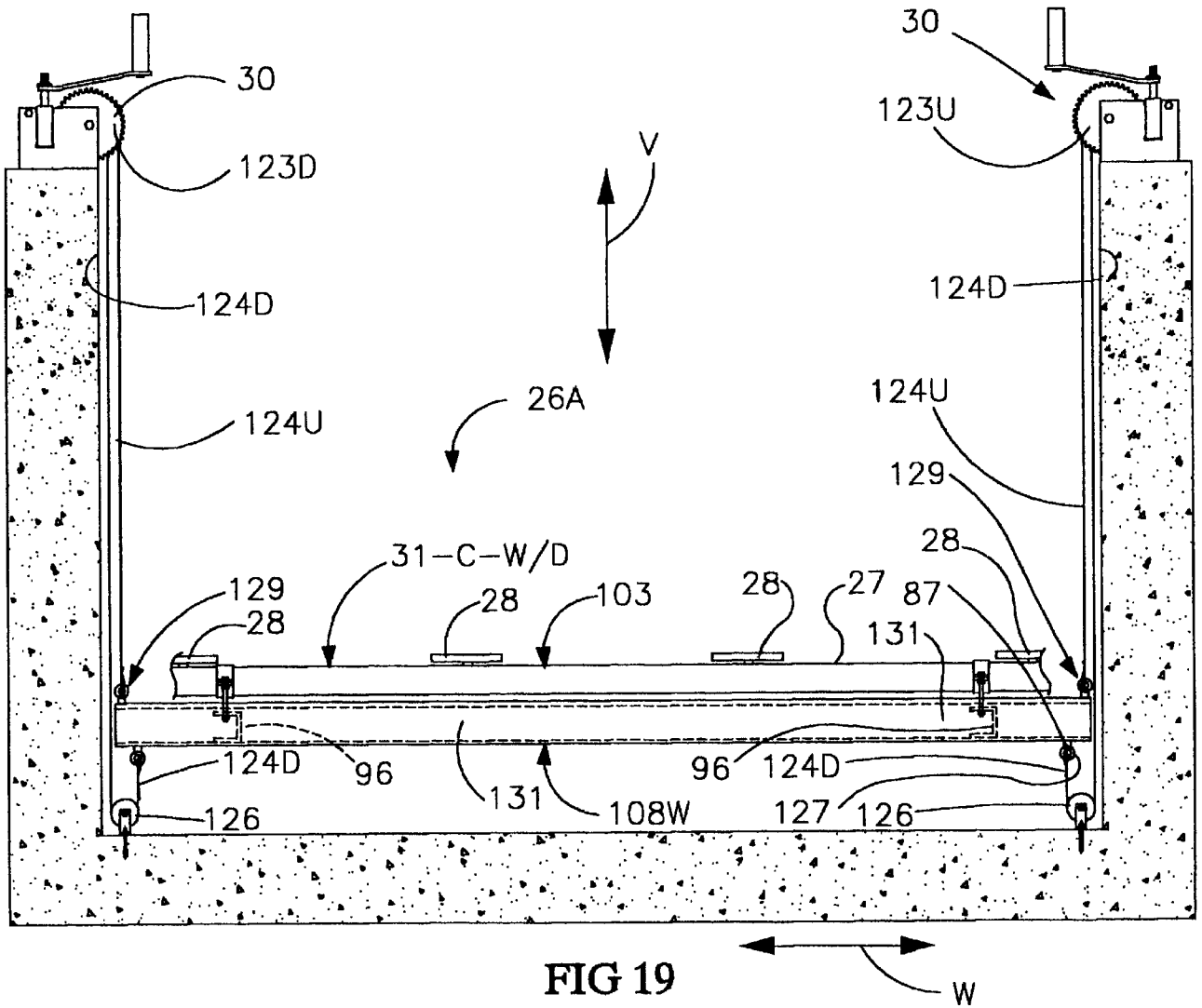
FIG. 19 is an elevational view showing a multiple winch embodiment of the aeration unit retrieval device of the compound movement embodiment of the present invention, wherein the winch embodiment applies vertical forces to a platform that carries the aeration unit, and guides of the platform allow the aeration unit to move in the second component of the compound movement.

When the aeration unit 26 needs to be moved into the basin 20 against the buoyant force, the downward first movement may be provided in response to gravitational force on weights (not shown). Alternatively, as shown in FIG. 19, and schematically in FIG. 21D, the first movement downward in the direction V into the basin 20 is provided by one of a series of four winches 123D, one at each corner 53W. Each winch 123D drives a cable 124D that extends around a pulley 126. The cable 124D is connected to the opposite ends of a channel 101W at spaced points 127, two of which are shown in FIG. 21D. The points 127 are shown in FIG. 13A, it being understood that the winches 123 are not used with the channels 101 shown in FIG. 14A. Also, the first movement upward in the direction V from the basin 20 is provided by one of a series of four winches 123U, two of which are shown in FIG. 21D. Each winch 123U drives a cable 124U that is connected to the opposite ends of the channel 101W at spaced points 129 (FIG. 19), two of which are shown in FIG. 21D located above the spaced points 127.

In FIGS. 18 and 19, the second movement of the compound movement is shown permitted by the guides 97, which include the respective opposed channels 101C and 101W. Each of the channels 101C and 101W extends in the direction S between respective lateral beams 96C and 96W. Each channel 101C and 101W defines one of the guide slots (or drawer guides) 102 that extend parallel to the direction S of the length L of the basin 20, which is the direction of the second movement of the compound movement.

One of the drawers 103 is shown in FIGS. 18 and 19 in a manner similar to the drawer 103 shown in FIGS. 13A. 13B, 14A, and 14B. Thus, in FIG. 18, the bars 104C extend in the direction of the width W of the basin 20. Each of the bars 104C has the opposite ends (or followers) 106C that are received in, and ride along, the slots 102C of the respective channels 101C and 101W. The bars 104C of the drawers 103C are connected to the pipes 27 of the section 26A of the aeration unit 26, it being understood that in each of FIGS. 18 and 19, there are four pipes 27 in each section 26A.

The slots 102C of the respective channels 101C and 101W cooperate with the followers 106C so that the guide slots 102C receive and retain the followers 106C, yet engage the followers 106C loosely enough to allow the followers 106C to move in the second compound direction S.

The corresponding structure in FIG. 19 is identified using a "W" after the reference number. The respective channels 101C and 101W, and the guides 97C and 97W (via the guide slots 102C and 102W in such channels 101C and 101W) are referred to in these embodiments 31-C-C/D and 31-C-W/D as the respective platforms 108C and 108W in that these elements carry the respective drawers 103C and 103W (with the aeration unit section 26A thereon) and cause the first movement of such section 26A, yet permit the second movement of such section 26A.

When the first compound movement has been completed, such that the platform 108C or 108W carrying the aeration unit section 26A has been moved out of the basin 20, the service personnel standing on the service area 34 adjacent to the near side 39 of the basin 20 may pull on the aeration unit section 26A by pulling on the drawer 103C or 103W of such section 26A in the direction S. As the drawer 103C or 103W moves in the direction S, the followers 106C or 106W are guided by the respective slots 102C or 102W. In this manner, the pipes 27 of the section 26A move in the second compound direction S with the respective drawer 103C or 103W. The drawer 103C or 103W, with the respective bars 104C or 104W, the followers 106C or 106W and the pipes 27, may thus move completely off the respective platform 108C or 108W and become positioned over the service area 34 for any necessary service or repair as described above.

It may be understood that the functions of the elements in the embodiments 31-C-C/D and 31-C-W/D shown in FIGS. 18 and 19 are the same as that described above with respect to the embodiment 31-C-V/D shown in FIGS. 13A–13C, and 14A–14C.

Compound Movement Embodiment 31-C-V/S of Retrieval Apparatus 31

Regardless of which of the embodiments 31-C-C, or 31-C-W, or 31-C-V is used for the first movement in the direction V, the second compound movement may be provided by the second compound movement embodiment shown in FIGS. 15A, 15B, 16A, and 16B. Considering FIGS. 15A and 15B, the embodiment 31-C-V/S is shown having one compression member 38 in the form of the truss 93 which supports the lateral beams 96. The truss 93 and its function as a compression member 38, and its cooperation with the vector force transfer device 42, are the same as described above.

Figure 15B:
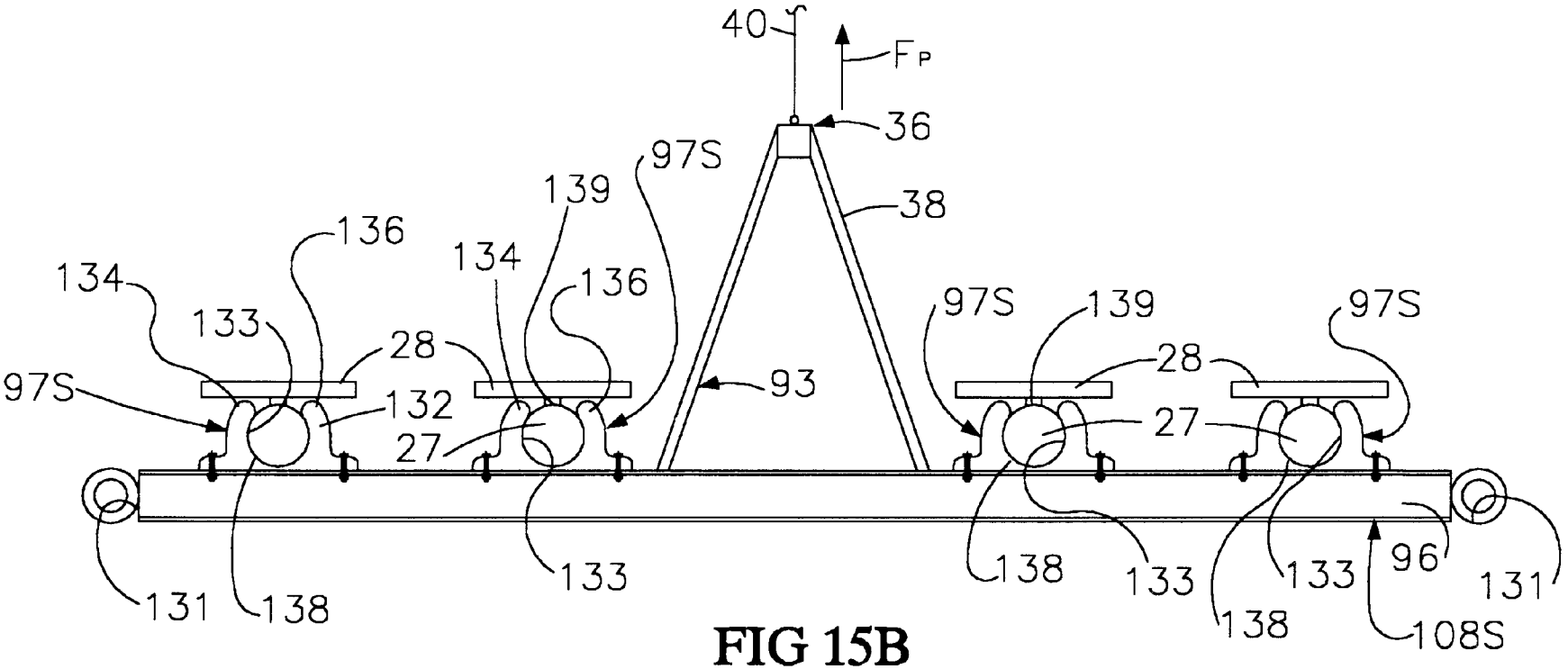
FIG. 15B is a cross sectional view taken along line 15B—15B in FIG. 15A showing the saddles supporting and guiding the second component of the compound movement the aeration unit, wherein the pipes of the aeration unit ride in the saddles to allow the aeration unit to move over the service area.

Alternatively, in place of the truss 93, each compression member 38 (i.e., each truss 93) may be in the form of a pair of cylindrical beams 131 shown in FIG. 15B and shown schematically in FIG. 21C. The lateral beams 96 and the cylindrical beams 131 define one of the frames 48 as shown in FIGS. 9B or 9C with a four-sided frame 48 shown in FIG. 21C. As described above, the corners 53 of the beams 96 and 131 receive components $F_{P1}$ and $F_{P2}$ of the primary force $F_P$. Each vector force transfer device 42 associated with the beam 131 (see compression member 27-CM in FIG. 9C) is shown schematically in FIG. 21C by the arrows H1. The vector force transfer device 42 responds to the respective force component $F_{P1}$ or $F_{P2}$ and causes all of the beams 131 and the beams 96 of the frame 48 move in unison in the first movement.

Whether the truss 93, or the beams 131, are used, the lateral beams 96 are used. For the second movement, as shown in FIG. 15B the lateral beams 96 carry many of the guides 97, which are in the form of guides 97S. The guides 97S are referred to as "saddles" 132 in that each saddle 132 is provided with a surface 133 having an open generally "U" shape. Arms 134 of the saddle 132 converge and define more than 180 degrees but are open at a top 136. The saddles 132 each have a longitudinal axis 137 that is parallel to the direction S of the second movement. The surfaces 133 are parallel to the axis 137. The beams 131 and the lateral beams 96 which define one of the frames 48 form the platform 108S which corresponds to the platform 108 described above with respect to FIGS. 13A and 14A, for example.

There are shown in FIGS. 15A and 15B four pipes 27 of an aeration section 26A of the aeration unit 26. Each pipe 27 has an outer surface 138 which serves as a follower 106 in that the outer surface 138 of each of the pipes 27 is received in one of the surfaces 133 of the saddles 132. Each of the pipes 27 is provided with a diffuser 28 having an inlet 139 that extends through the open top 136 of the saddle 132. The surfaces 133 are dimensioned to loosely receive the outer surfaces 138, yet the arms 134 partially enclose the pipes 27 to hold the pipes 27 in the surfaces 133 and on the platform 108S. The surface 133 may be provided with a coating of a slippery material such as PTFE sold under the trademark "Teflon" to permit easy sliding of the outer surfaces 138 of the pipe 27 relative to the surfaces 133. With the axes 137 aligned with the direction S, it may be understood that the pipes 27 may be slid along the saddles 132 in the direction S to permit the second movement of the sections 26A over the service area 34 as described above with respect to the other sections 26A, 26B, etc.

Figure 16B:
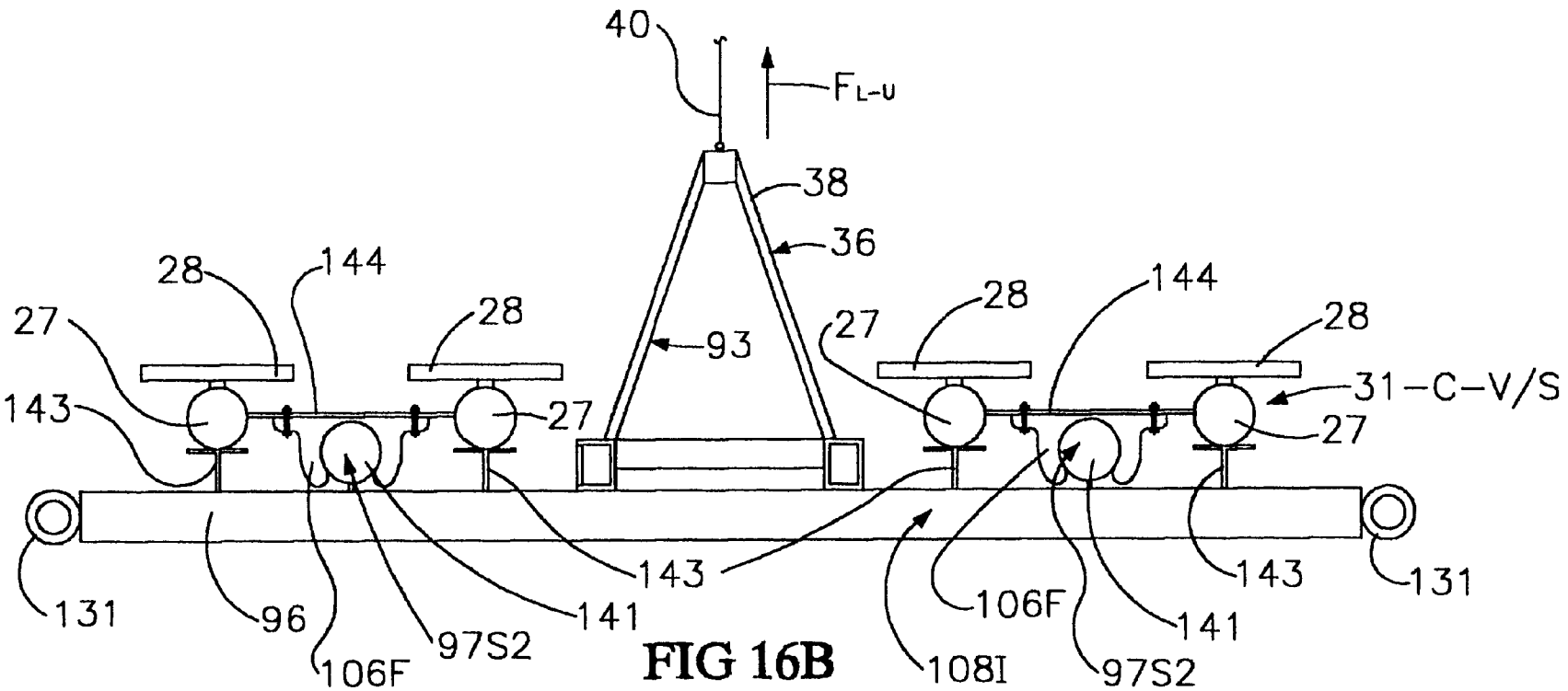
FIG. 16B is a cross sectional view taken along line 16B—16B in FIG. 16A showing the second platform and the saddles.

Considering FIGS. 16A and 16B, the compression member 38 is shown in the form of the truss 93 which supports the lateral beams 96. Each beam 96 may be in the form of a cylindrical beam. Two such beams 96 are shown in FIG. 16A. The primary force $F_P$ is received by the truss 93 which moves the lateral beams 96 in the first movement in the direction V.

For the second movement, the lateral beams 96 carry many of the guides 97, which are identified as guides 97S2. The guides 97S2 are in the form of cylindrical structural pipes 141 which cooperate with inverted U-shaped followers 106F. The followers 106F are also referred to as "saddles" 132I in that each saddle 132I is shaped similarly to the saddles 97S, or 132, shown in FIGS. 15A and 15B, and are provided with a guide surface 133I. Arms 134I of the saddles 132I converge and define more than 180 degrees, but are open at a bottom 142. The saddles 132I each have a longitudinal axis 137I that is parallel to the direction S of the second movement. The surfaces 133I are parallel to the axis 137. T-shaped supports 143 are mounted to the lateral beams 96 to keep the pipes 27 level. The truss 93 and the lateral beams 96 and the longitudinal guide beam pipes 141 define one of the platforms 108I which corresponds to the platform 108 described above with respect to FIGS. 13A and 14A, for example.

There are shown in FIGS. 16A and 16B four pipes 27 of an aeration section 26A of the aeration unit 26. Each pipe 27 is connected to a bridge 144 that is secured to one of the inverted saddles 132I so that the pipes 27 are guided by the inverted saddles 132I for the second movement. Each of the pipes 27 is provided with a diffuser 28 in the normal manner described above. The surfaces 133I are dimensioned to loosely receive the outer surfaces 138, yet the arms 134I partially enclose the longitudinal pipe beams 141 to hold the saddles 132I on the beams 141 and on the platform 108I. The surface 133I may also be provided with a coating of a slippery material such as PTFE sold under the trademark "Teflon" to permit easy sliding of the surface 133I relative to the beam 141. With the axes 137 aligned with the direction S, it may be understood that the saddles 132I slide along the beams 141 in the direction S to permit the second movement of the sections 26A over the service area 34 as described above with respect to the other sections 26A, 26B.

It may be understood that in the embodiment 31-C-V/S shown in FIGS. 15A–15B and 16A–16B, the module 36 (e.g., the truss 93 with the force applicator 40 and the vector force transfer device 42) performs the function of lifting the platform 108I and the aeration unit section 26A out of the basin 20 to a predetermined vertical position (see "VP" in FIG. 17B) over the basin 20. Such lifting provides the first movement (up in FIG. 15B) to the vertical position VP (FIG. 17B) over the basin 20. Also, the platform 108I (via the truss 93, or the beams 131, and the lateral beams 96) provides the function of supporting an individual aeration unit section, e.g., 26A. Such support is for the first of the compound movements, e.g., vertical. Also, the guides 97S and 97S2, with the follower surface 133 (FIG. 15B) or the follower 106F (FIG. 16B), serve the function of mounting the sections (e.g., 26A) of the aeration unit 26 for horizontal movement relative to the retrieval apparatus 31-C-V independently of the first compound movement. That is, the section 26A, for example, may move in the second direction S apart from the motion of, or relative to, the platform 108. Further, the guides 97S, via the saddles 132 and the guide surfaces 133 (FIG. 15B), and the pipe guides 141 and the guides 106F (FIG. 16B), serve the function of guiding the second of the compound movement, which is of the pipes 27 (FIG. 15B) and of the bridge 144 and the pipes 27 (FIG. 16B), relative to the retrieval apparatus 31-C-V to permit a far side 83 of the aeration unit sections (e.g. 26A) to move adjacent to the near side 39 of the basin 20. Such guiding of the far side 83 ends when either the:

(1) follower surfaces 133 exit from the saddles 132, or (2) followers 106F move off the pipe guides 141 (of the guides 97S2), adjacent to the near side 39 for the servicing of the aeration unit section (e.g., 26A).

The guiding function is thus performed with the saddles 132 and the guide pipes 141 extending in the direction S perpendicular to the wall 22 at the service side 39 of the basin 20.

Further, the saddles 132 with the arms 134 and the surfaces 133, and the pipes 141 with the followers 106F, serve the function of permitting the aeration unit sections (e.g., 26A) to move in such second of the compound movements. Similarly, the saddles 132 with the arms 134 and the surfaces 133, and the pipes 141 with the followers 106F, serve the function of slidably mounting the pipes 27 for return movement in a direction of a return arrow 117, which is the second of the compound movements in the S direction opposite to that of the arrow 116.

Additionally, the arms 134 of the saddles 132, and the followers 106F, function to hold the respective aeration unit section (e.g., 26A) that is connected to the saddles 132 or to the followers 106F, down against the buoyant forces when the aeration unit section (e.g., 26A) is in the basin 20 under the liquid 21.

It may be understood then, that the various embodiments of the guides 97 each perform the function of holding the respective aeration unit section 26A, etc. at the vertical position VP (FIG. 17B) while allowing the aeration unit section 26A to move horizontally in the second movement of the compound movement in the direction S off the platform 108 and over the service area 34.

Multi-Section 26A Embodiment 31-C-V/D

As described above, in the compound movement embodiment 31-C, one section 26A of the aeration unit 26 is shown in FIG. 13A for aerating a portion of the basin 20 between the outer walls 22. Also, in FIG. 17A, a basin 20 is shown having a sixty foot length L60. For ease of maintenance, such basin 20 is shown having many of sections 26A and 26B. On the left of FIGS. 17A and 17B, one of two adjacent aeration unit sections 26A-1 is shown mounted on one side of a first module 36, identified as 36L. The other of the two adjacent aeration units 26A-2 (not shown) is mounted on the other side of the module 36L. On the right side of FIGS. 17A and 17B, one of two adjacent aeration unit sections 26B-l is shown mounted on the one side of a second module 36, identified as 36R. The other of the two adjacent aeration units 26B-2 (not shown) is mounted on the other side of the module 36R.

This arrangement illustrates the adaptability of the present invention in providing compound movement for various arrangements of aeration unit sections 26A, etc. In particular, the left module 36L, for example, may be used to service the two sections 26A-1 and 26A-2, while the sections 26B-1 and 26B-2 continue to operate to aerate the liquid 21 in the basin 20.

The structure of each module 36L and 36R is as described above, such that the primary force $F_P$ is provided to each module 36L and 36R by a separate drive 41L and 41R for the respective module 36L and 36R. The structure described with respect to FIGS. 5–7 is used so that each module 36L and 36R will be usable separately to provide the first movement of the platform 108L or 108R provided on each of the compression members 38 of such modules 36L and 36R.

As shown in FIG. 17A, the basin 20 has one service section 34L on the left of the basin 20, and one service area 34R on the right of the basin 20. Thus, after the first movement of a particular platform 108L or 108R, the second movement is performed using the guides 97 of the platforms 108L and 108R to move the respective sections 26A and 26B onto a separate service area 34A and 34B at which to perform the servicing of the aeration units 26A-1 or 26A-2, or 26B-1 or 26B-2.

Compound Movement Methods

Referring to FIGS. 13A and 17A, a method of the present invention provides compound movement of an aeration unit 26 that is normally installed at the bottom 24 of a waste treatment basin 20. As described, the aeration unit 26 has a characteristic of requiring periodic servicing. For such purpose, the work or service area 34 is provided adjacent to the basin 20 (and in FIG. 17A two areas 34L and 34R are shown). The method involves the steps of mounting the aeration unit 26 (or each section 26A or 26B in FIG. 17A) on the platform 108. Next, there is a step of first moving the platform 108 (or one of the platforms 108L or 108R in FIG. 17A) upwardly out of the basin 20 (FIGS. 13B and 17B) to move the aeration unit 26 out of the basin 20 to the vertical position VP (FIG. 17B) over the basin 20 and spaced horizontally from the work area 34. To complete the compound movement, another step is second moving the aeration unit 26 horizontally relative to the platform 108 to the work area 34 for servicing, wherein during the second movement the aeration unit 26 remains at the vertical height of the position VP.

In another aspect of the method of the present invention, as shown in FIG. 20, the second compound movement is continued after the A-1 aeration unit section 26A has been moved to the first position A-2 over the service area 34. The A-1 aeration unit 26A is moved (see arrow SA-2) from the second position A-2 (which is off the platform 108) to a third position A-3 over the service area 34 to make room for the substitute, next B-1 aeration unit section 26A. The B-1 section 26A is moved (arrow SA-3) from its first position B-3 to its second position B-2 and then (arrow SA-4) onto the guides 97 of the platform 108 for opposite first movement (up in FIG. 20) on the platform 108 over the basin 20. The platform 108 is then moved in the reverse direction (e.g., downwardly in FIG. 13B) of the first of the compound movements to move the B-1 aeration unit 26A into the basin 20.

Review of Present Invention

In view of the above description and drawings, it may be understood that due to use of the platforms 108 on the compression members 38 to carry various types of aeration unit sections 26A, etc., the compression members 38 of the present invention are adaptable to carry almost any type of aeration unit 26. Also, the compression members 38 may be provided for small basins 20 (e.g., as shown in FIG. 13A), or large basins 20 (e.g., as shown in FIG. 17A), or for the circular basins (not shown) described above. Similarly, although the vector force transfer device 42 is a preferred embodiment for providing the first of the compound movement, the cables 29 or winches 123 may be used as necessary where their disadvantages are not critical.

In all of these embodiments, the service areas 34 may be located such that service personnel have easier and safer access to the pipes 27, to the diffusers 28, and to the levelling devices 111, than there would be if the aeration units 26 were positioned over the basin 20 for servicing, for example. In this manner, the service personnel do not have to climb onto the aeration unit 26 structure when it is over the basin 20, and are thus not exposed to the risk of falling into the liquid 21 in the basin 20, for example.

The foregoing description of the present invention illustrates and describes the invention and is not intended to limit the invention to the form disclosed herein. The embodiments disclosed are intended to describe the best modes known of practicing the invention and to enable others skilled in the art to use such invention in such or other embodiments. It is intended that the appended claims be interpreted so as to include alternative embodiments to the extent permitted by the prior art.

What is claimed is:

1. A method of replacing a first aeration unit of a water treatment basin with a second aeration unit, said method comprising the steps of:

providing said basin with a service area at which said replacement is performed, said service area being adjacent to said basin and having first, second and third portions, said first portion being normally aligned with said first aeration unit;

first moving said first aeration unit upwardly out of said basin to a first position over said basin;

second moving said first aeration unit sideways of said basin from said first position over said basin to a second position over said first portion of said service area;

third moving said first aeration unit from over said first portion to said third portion of said service area; and moving said second aeration unit across said first portion of said service area and over said basin.

2. A method according to claim 1, comprising the further steps of:

providing said second aeration unit at said second portion of said service area;

moving said second aeration unit from said second portion to said first portion and then over said basin after said third moving.

3. A method of compound movement of an aeration unit that is normally installed at a bottom of a waste treatment basin, said aeration unit having a characteristic of requiring periodic servicing, a work area being adjacent to said basin, said method comprising the steps of:

mounting said unit on a platform first moving said platform upwardly out of said basin to move said aeration unit out of said basin to a vertical position spaced horizontally from said work area; and second moving said aeration unit horizontally relative to said platform from said vertical position to said work area for said servicing.

4. A method of transferring an aeration unit from the bottom of a waste treatment basin to a service area adjacent to said waste treatment basin, said method comprising the steps of:

providing a platform for mounting said aeration unit, said platform having a near end adjacent to said service area and a far end away from said service area;

applying a vertical upward force to said near end of said platform;

vector force transferring components of said vertical force to said far end to move both said ends of said platform, and said aeration unit, out of said basin while keeping said platform substantially level; and moving said aeration unit horizontally off said platform and onto said service area.

5. A method according to claim 4, wherein said aeration unit is returned to said bottom of said basin, comprising the further steps of:

moving said aeration unit after servicing, or moving a substitute aeration unit, onto said platform while said platform is out of said basin;

applying a vertical downward force to said near end of said platform; and reversing said vector force transferring to transfer components of said vertical downward force to said far end to move both said ends of said platform, and said aeration unit, into said basin while keeping said platform and said serviced or substitute aeration unit substantially level.

* * * * *